US011297918B1

(12) United States Patent
Chan et al.

(10) Patent No.: US 11,297,918 B1
(45) Date of Patent: Apr. 12, 2022

(54) CASE FOR PORTABLE ELECTRONIC COMPUTING DEVICE

(71) Applicant: Pioneer Square Brands, Inc., Seattle, WA (US)

(72) Inventors: Jaimie Emerald Chan, Renton, WA (US); Michael Cooper Ferren, Camas, WA (US); Brian Lewis Piper, Seattle, WA (US); Tyler Ray MacLeod Kope, Mercer Island, WA (US)

(73) Assignee: PIONEER SQUARE BRANDS, INC., McLean, VA (US)

( * ) Notice: Subject to any disclaimer, the term of this patent is extended or adjusted under 35 U.S.C. 154(b) by 0 days.

(21) Appl. No.: 17/408,327

(22) Filed: Aug. 20, 2021

(51) Int. Cl.
*A45C 11/00* (2006.01)
*A45C 13/00* (2006.01)

(52) U.S. Cl.
CPC ..... *A45C 11/00* (2013.01); *A45C 13/005* (2013.01); *A45C 2011/003* (2013.01)

(58) Field of Classification Search
CPC . A45C 11/00; A45C 13/005; A45C 2011/002; A45C 2011/003
USPC ..... 206/320
See application file for complete search history.

(56) References Cited

U.S. PATENT DOCUMENTS 5,028,075 A * 7/1991 Donnelly ..... B42F 9/00 281/49
9,489,020 B2 * 11/2016 Ahee ..... G06F 1/1626
2006/0226040 A1 * 10/2006 Medina ..... G06F 1/1616 206/320
2017/0196328 A1 * 7/2017 Rogers ..... G06F 1/1626

* cited by examiner

*Primary Examiner* — Steven A. Reynolds
(74) *Attorney, Agent, or Firm* — Grandview Law

(57) ABSTRACT

Systems and methods are involved for a portable electronic computing device the system includes (I) a first case section to receive a first device portion, (II) a second case section to receive a second device portion, and (III) a sheet member coupled with and extending between the first case section and the second case section including the sheet member being able to flexibly change between (A) being received by a recess in the first case section and a recess in the second case section, and (B) being other than received by the recesses. In addition, other aspects are described in the claims, drawings, and text forming a part of the present disclosure.

10 Claims, 19 Drawing Sheets

CASE FOR PORTABLE ELECTRONIC COMPUTING DEVICE

SUMMARY

In one or more aspects, a system can include a system for a portable electronic computing device including a first device portion, a second device portion, and a hinge portion, the first device portion hingedly coupled with the second device portion via the hinge portion, the system including (I) a first case section including (A) a base including an interior surface, (B) a first side including a first wall with the first wall extending perpendicularly to the interior surface, (C) a second side including a second wall with the second wall extending perpendicularly to the interior surface, and (D) a third side including a third wall with the third wall extending perpendicularly to the interior surface, wherein the first wall extends perpendicularly to the second wall, and wherein the first wall extends parallel with the third wall such that the first case section being configured to receive the first device portion of the portable electronic computing device; (II) a second case section including (A) a base including an interior surface, (B) a first side including a first wall with the first wall extending perpendicularly to the interior surface, (C) a second side including a second wall with the second wall extending perpendicularly to the interior surface, and (D) a fourth side including a third wall with the third wall extending perpendicularly to the interior surface, wherein the first wall extends perpendicularly to the third wall, and wherein the first wall extends parallel with the second wall such that the second case section being configured to receive the second device portion of the portable electronic computing device; and (III) a sheet member including (A) a base coupled to the first case section and coupled to the second case section, (B) the sheet member including at least one portion of the base being able to flexibly change between at least one first spatial contour and at least one second spatial contour, (C) a first surface portion of the base being in physical contact with a second surface portion of the base when the at least one portion of the base is in the at least one first spatial contour, and (D) the first surface portion of the base being without physical contact with the second surface portion of the base when the at least one portion of the base is in the at least one second spatial contour. Wherein the base of the sheet member is hingedly coupled to the first case section and hingedly coupled to the second case section. Wherein the base of the sheet member includes at least one mid-hinge, at least one first segment, and at least one second segment, the at least one mid-hinge being positioned between the at least one first segment, and the at least one second segment. Wherein the at least one mid-hinge includes at least one first notch and at least one second notch. Wherein at least one portion of the at least one first segment of the base of the sheet member being in physical contact with at least one portion of the at least one second segment of the base of the sheet member when the at least one portion of the base of the sheet member is in the at least one first spatial contour. Wherein the first case section includes a recess, the second case section includes a recess, and when the at least one portion of the base of the sheet member is in the at least one first spatial contour, the at least one first segment of the base of the sheet member is being received by the recess of the first case section and the at least one second segment of the base of the sheet member is being received by the recess of the second case section. Wherein the base of the sheet member includes a first segment, a second segment, a third segment, a fourth segment, a mid-hinge positioned between the first segment and the second segment, a mid-hinge positioned between the second segment and the third segment, and a mid-hinge positioned between the third segment, and the fourth segment. Wherein when the base of the sheet member is in the at least one first spatial contour, at least one portion of the first segment is in physical contact with at least a portion the second segment, at least one portion of the second segment is in physical contact with at least a portion of the third segment, and at least one portion of the third segment is in physical contact with at least a portion of the fourth segment. Wherein the device case assembly includes a recess and when the at least one portion of the base of the sheet member is in the at least one first spatial contour, the first segment and the second segment of the base of the sheet member is being received by the recess. Wherein the recess of the device case assembly is positioned in the first case section. Wherein the base of the sheet member being so coupled to the first case section and so coupled to the second case section to allow for 360-degree rotation of orientation of the first case section with respect to the second case section. Wherein when the at least one portion of the base of the sheet member is in the at least one first spatial contour, the base of the sheet member is being folded over once onto itself. Wherein when the at least one portion of the base of the sheet member is in the at least one first spatial contour, the base of the sheet member is being folded over thrice onto itself. Wherein the first case section, the second case section, and the sheet member are co-molded. Wherein at least one of more portions of the base of the sheet member is made of a fabric material. Wherein at least one portion of the base of the sheet member is made of a flexible synthetic material selected from a list including but not limited to metalized material, acrylonitrile material (ABS), low density polyethylene (LDPE) material, flexible plastic material, polyvinyl chloride material, thermoplastic polyurethane material, and silicone material. Wherein at least one portion of the first case section and at least one portion of the second case section are made of a hard material selected from a list including but not limited to high-density polyethylene (HDPE) plastic.

In one or more aspects, a system can include a system for a portable electronic computing device including a first device portion, a second device portion, and a hinge portion, the first device portion hingedly coupled with the second device portion via the hinge portion, the system including (I) a first case section including (A) a base including an interior surface such that the first case section being configured to receive the first device portion of the portable electronic computing device; (II) a second case section including (A) a base including an interior surface such that the second case section being configured to receive the second device portion of the portable electronic computing device; and (III) a sheet member coupled with and extending from the first case section and coupled with and extending from the second case section including at least one portion of the sheet member being able to flexibly change between (A) a first position in which a first portion of the sheet member is with physical contact with a second portion of the sheet member, and (B) a second position in which the first portion of the sheet member is without physical contact with the second portion of the sheet member.

In one or more aspects, a system can include a system for a portable electronic computing device including a first device portion, a second device portion, and a hinge portion, the first device portion hingedly coupled with the second device portion via the hinge portion, the system including (I) a first case section including (A) a base including an interior surface such that the first case section being configured to receive the first device portion of the portable electronic computing device, (B) wherein the base includes a recess; (II) a second case section including (A) a base including an interior surface such that the second case section being configured to receive the second device portion of the portable electronic computing device, (B) wherein the base includes a recess; and (III) a sheet member coupled with and extending from the first case section and coupled with and extending from the second case section including at least one portion of the sheet member being able to flexibly change between (A) a first position in which a first portion of the sheet member is being received by the recess and a second portion of the sheet member is being received by the recess, and (B) a first position in which a first portion of the sheet member is being other than received by the recess and a second portion of the sheet member is being other than received by the recess. Wherein at least one portion of the base of the sheet member is made of a flexible synthetic material selected from a list including but not limited to metalized material, acrylonitrile material (ABS), low density polyethylene (LDPE) material, flexible plastic material, polyvinyl chloride material, thermoplastic polyurethane material, and silicone material, and wherein at least one portion of the first case section and at least one portion of the second case section are made of a hard material selected from a list including but not limited to high-density polyethylene (HDPE) plastic.

In addition to the foregoing, other aspects are described in the claims, drawings, and text forming a part of the disclosure set forth herein. Various other aspects are set forth and described in the teachings such as text (e.g., claims and/or detailed description) and/or drawings of the present disclosure. The foregoing is a summary and thus may contain simplifications, generalizations, inclusions, or omissions of detail; consequently, those skilled in the art will appreciate that the summary is illustrative only and is NOT intended to be in any way limiting. Other aspects, features, and advantages of the devices and/or processes and/or other subject matter described herein will become apparent in the teachings set forth herein.

BRIEF DESCRIPTION OF THE FIGURES

For a more complete understanding of implementations, reference now is made to the following descriptions taken in connection with the accompanying drawings. The use of the same symbols in different drawings typically indicates similar or identical items, unless context dictates otherwise.

With reference now to the figures, shown are one or more examples of a case for portable electronic computing device systems, articles of manufacture, compositions of matter for same that may provide context, for instance, in introducing one or more processes and/or devices described herein.

DETAILED DESCRIPTION

Figure 1:
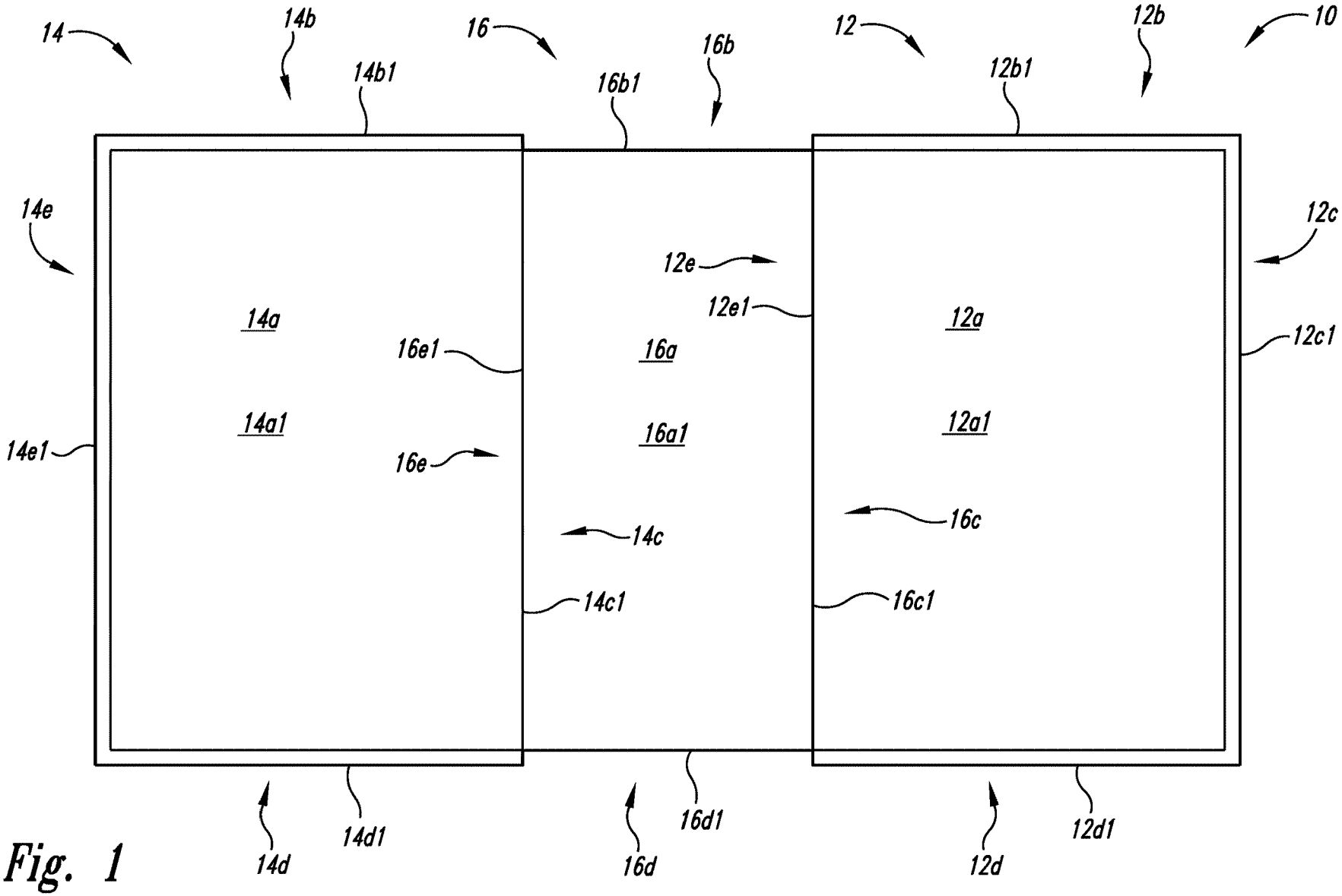
FIG. 1 is an anterior plan view of device case assembly including sheet member, first case section, and second case section for portable electronic computing device with sheet member coupled to first case section and second case member.

In the following detailed description, reference is made to the accompanying drawings, which form a part hereof. In the drawings, similar symbols typically identify similar components, unless context dictates otherwise. The illustrative implementations described in the detailed description, drawings, and claims are not meant to be limiting. Other implementations may be utilized, and other changes may be made, without departing from the spirit or scope of the subject matter presented here.

Turning to FIG. 1, depicted therein is an anterior plan view of device case assembly including sheet member, first case section, and second case section for portable electronic computing device with sheet member coupled to first case section and second case member. In implementations, device case assembly 10 is shown to include first case section 12, second case section 14, and sheet member 16. In implementations, first case section 12 is shown to include base 12*a* with interior surface 12*a*1, first side 12*b* with first wall 12*b*1, second side 12*c* with second wall 12*c*1, third side 12*d* with third wall 12*d*1, and fourth side 12*e* with edge 12*e*1. In implementations, second case section 14 is shown to include base 14*a* with interior surface 14*a*1, first side 14*b* with first wall 14*b*1, second side 14*c* with edge 14*c*1, second side 14*d* with second wall 14*d*1, fourth side 14*e* with third wall 14*e*1. In implementations, first case section 12 is shown to include base 12*a* with interior surface 12*a*1, first side 12*b* with first wall 12*b*1, second side 12*c* with second wall 12*c*1, third side 12*d* with third wall 12*d*1, and fourth side 12*e* with edge 12*e*1.

Figure 2:
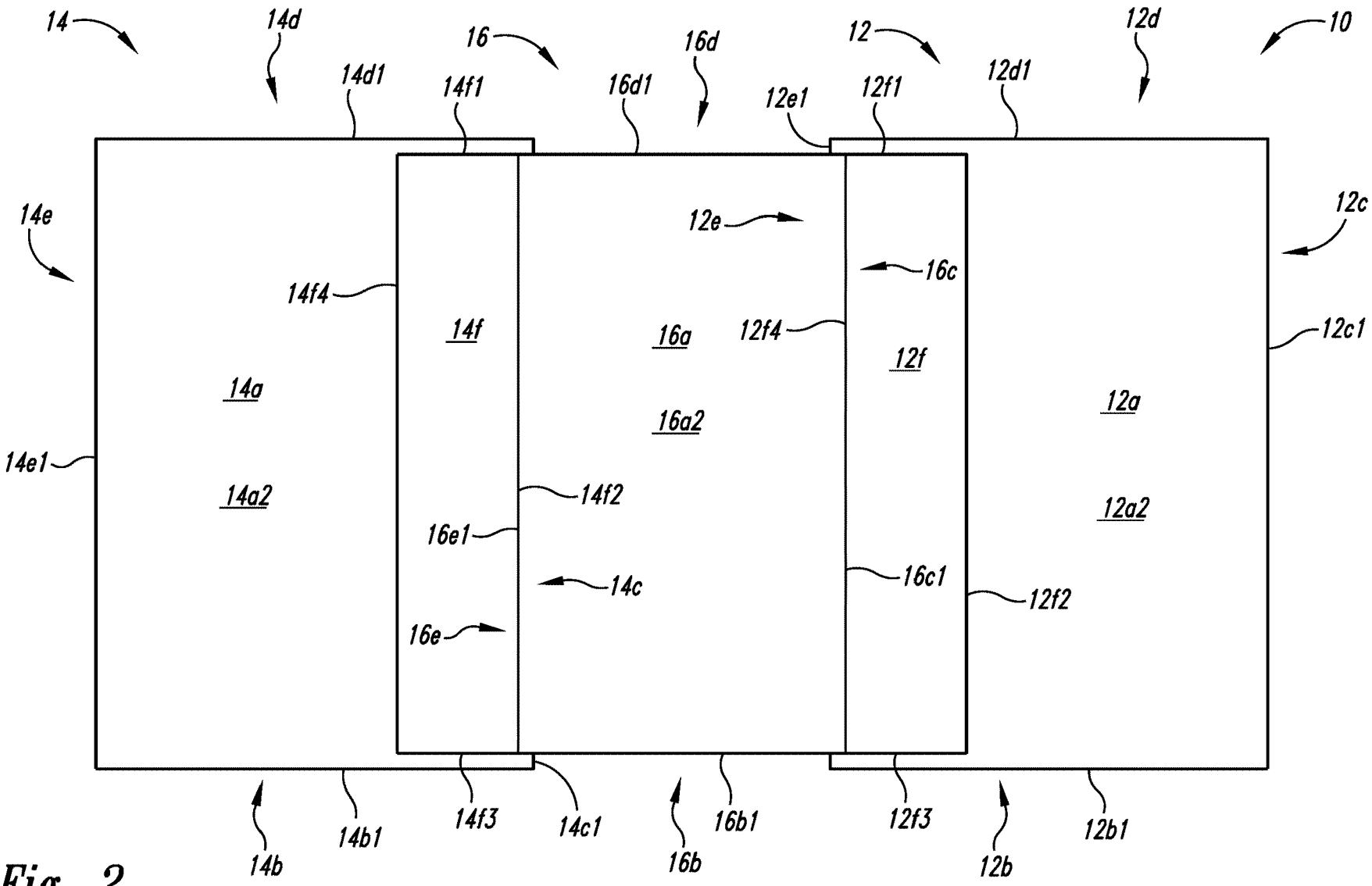
FIG. 2 is a posterior plan view of device case assembly of FIG. 1.

Turning to FIG. 2, depicted therein is a posterior plan view of device case assembly of FIG. 1. In implementations, base 12*a* is shown to include exterior surface 12*a*2 In implementations, third wall 12*d*1 is shown to include recess 12*d*1*a*. In implementations, first case section 12 is shown to include recess 12*f* with first side 12*f*1, second side 12*f*2, third side 12*f*3, and fourth side 12*f*4. In implementations, base 14*a* is shown to include exterior surface 14*a*2. In implementations, recess 14*f* is shown to include recess 14*f*, second side 14*f*2, third side 14*f*3, and fourth side 14*f*4. In implementations, base 16*a* is shown to include exterior surface 16*a*2.

Figure 3:
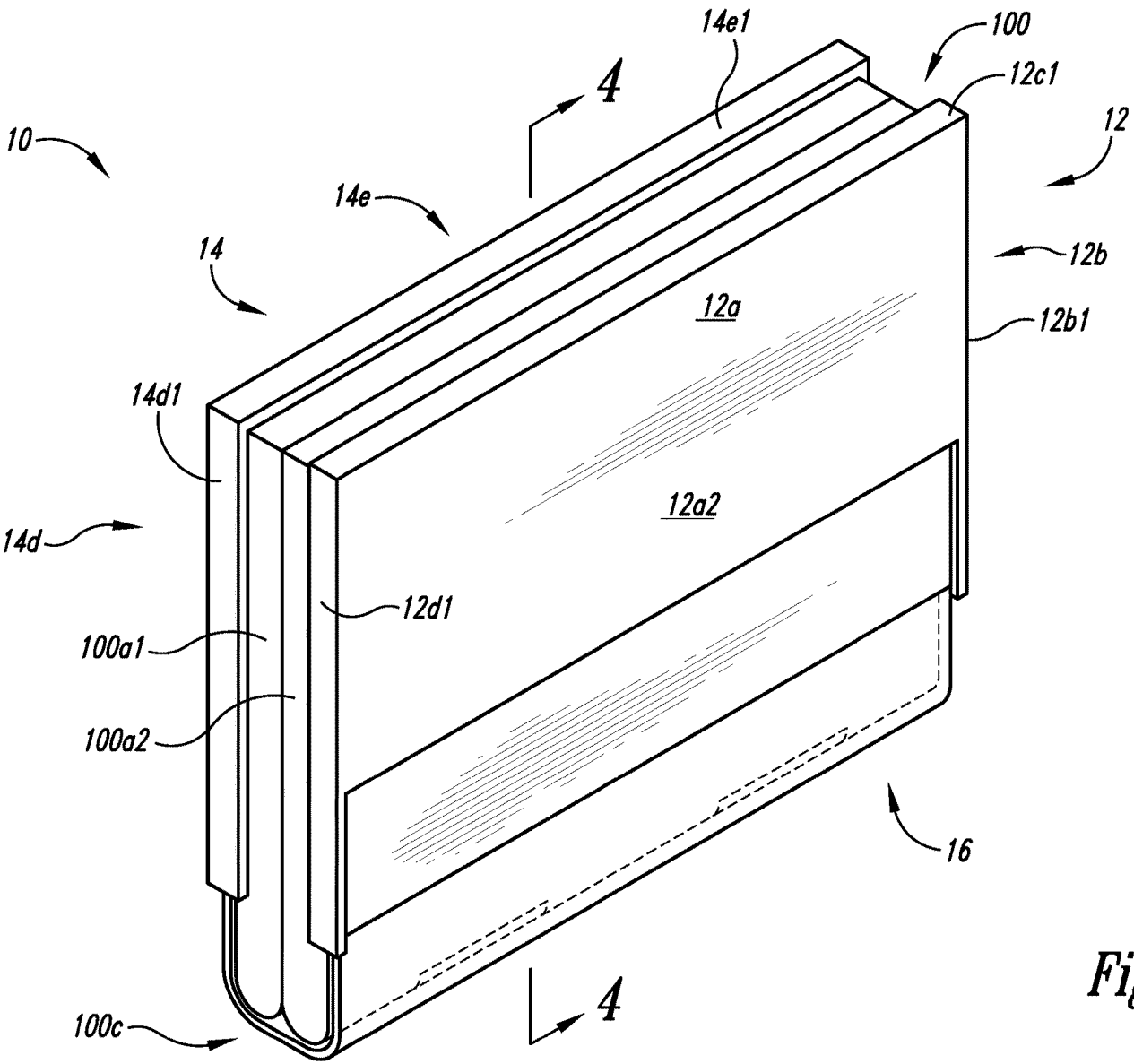
FIG. 3 is a perspective view of device case assembly configuration of FIG. 1.

Turning to FIG. 3, depicted therein is a perspective view of device case assembly configuration of FIG. 1 in first configuration. In implementations, device case assembly 10 is shown to hold portable electronic computing device 100 with first device portion 100*a*1 (e.g. display portion or keyboard portion), second device portion 100*a*2 (e.g. keyboard portion or display portion), and hinge portion 100*c* in first spatial contour such as, for instance, to hold portable electronic computing device 100 as a closed laptop.

Figure 4:
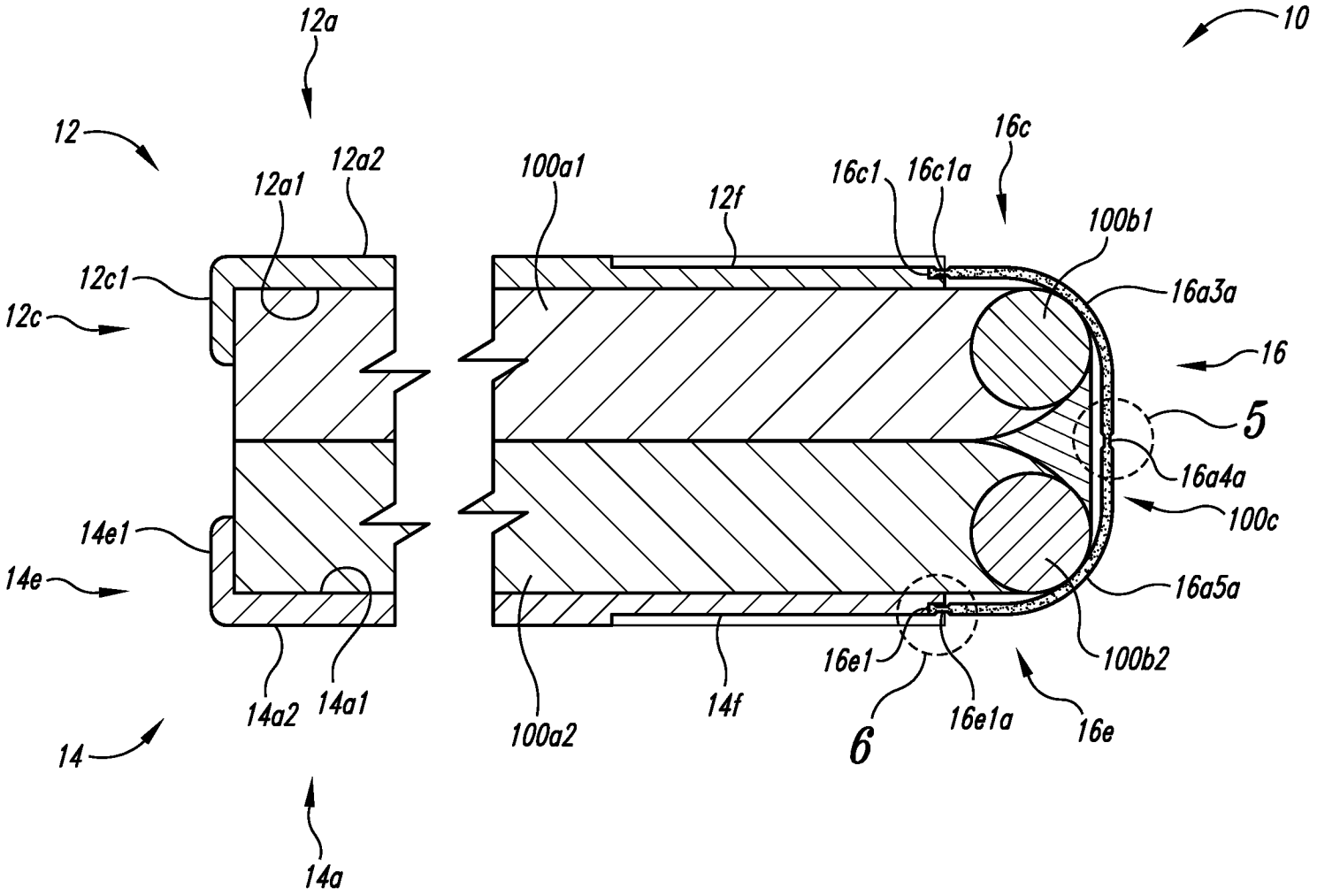
FIG. 4 is a side-elevational cross-sectional view of device case assembly in a first configuration of FIG. 3 taken along the cut line 4-4 shown in FIG. 3 in a first spatial contour.

Turning to FIG. 4, depicted therein is a side-elevational cross-sectional view of device case assembly in first configuration of FIG. 3 taken along the cut line 4-4 shown in FIG. 3 in first spatial contour. In implementations, device case assembly 10 is shown to contain portable electronic computing device 100 with first pivot 100*b*1 and second pivot 100*b*2. In implementations, base 16*a* is shown to include first segment 16*a*3*a*, mid-hinge 16*a*4*a*, second segment 16*a*5*a*, end-hinge 16*c*1*a*, and end-hinge 16*e*1*a*.

Figure 5:
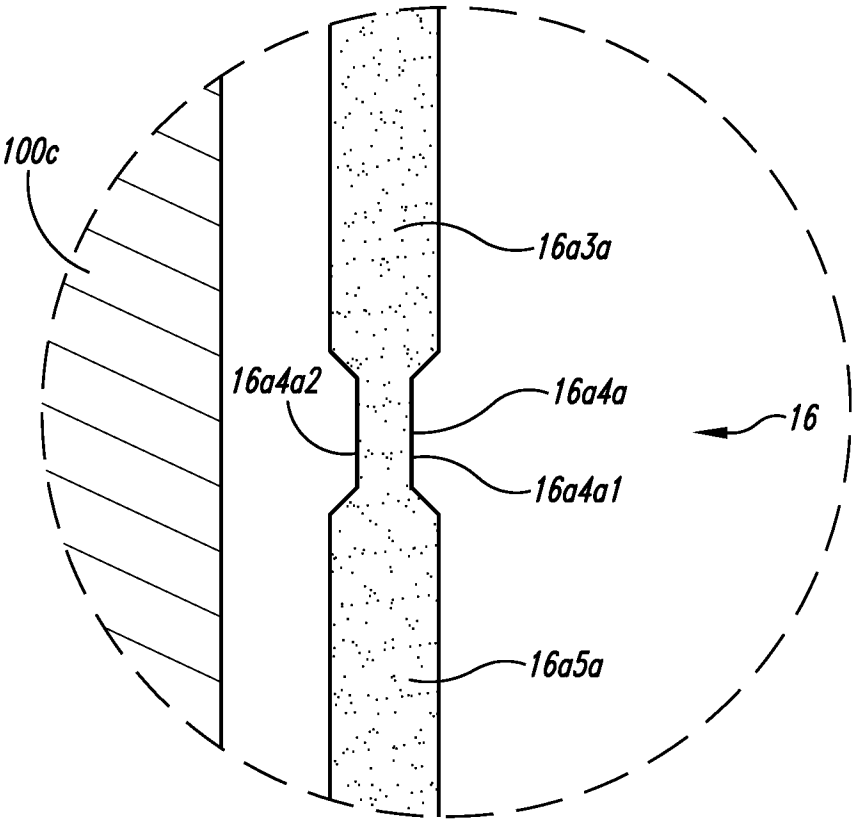
FIG. 5 is an enlarged side elevational cross-sectional view of a dashed-circle portion of the device case assembly of FIG. 4 labeled "5" shown in FIG. 4.

Turning to FIG. 5, depicted therein is an enlarged side elevational cross-sectional view of a dashed-circle portion of the device case assembly of FIG. 4 labeled "5" shown in FIG. 4. In implementations, mid-hinge 16*a*4*a* is shown to include first notch 16*a*4*a*1 and second notch 16*a*4*a*2.

Figure 6:
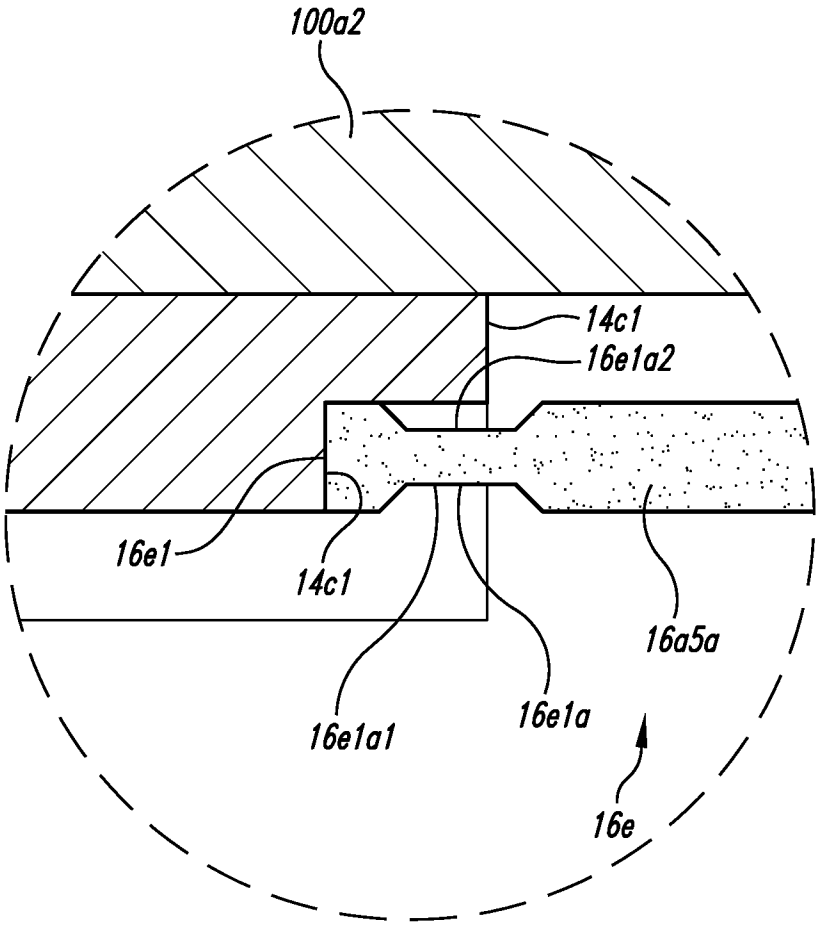
FIG. 6 is an enlarged side elevational cross-sectional view of a dashed-circle portion of the device case assembly of FIG. 4 labeled "6" shown in FIG. 4.

Turning to FIG. 6, depicted therein is an enlarged side elevational cross-sectional view of a dashed-circle portion of the device case assembly of FIG. 4 labeled "6" shown in FIG. 4. In implementations, end-hinge 16*e*1*a* is shown to include first notch 16*e*1*a*1 and second notch 16*e*1*a*2.

Figure 7:
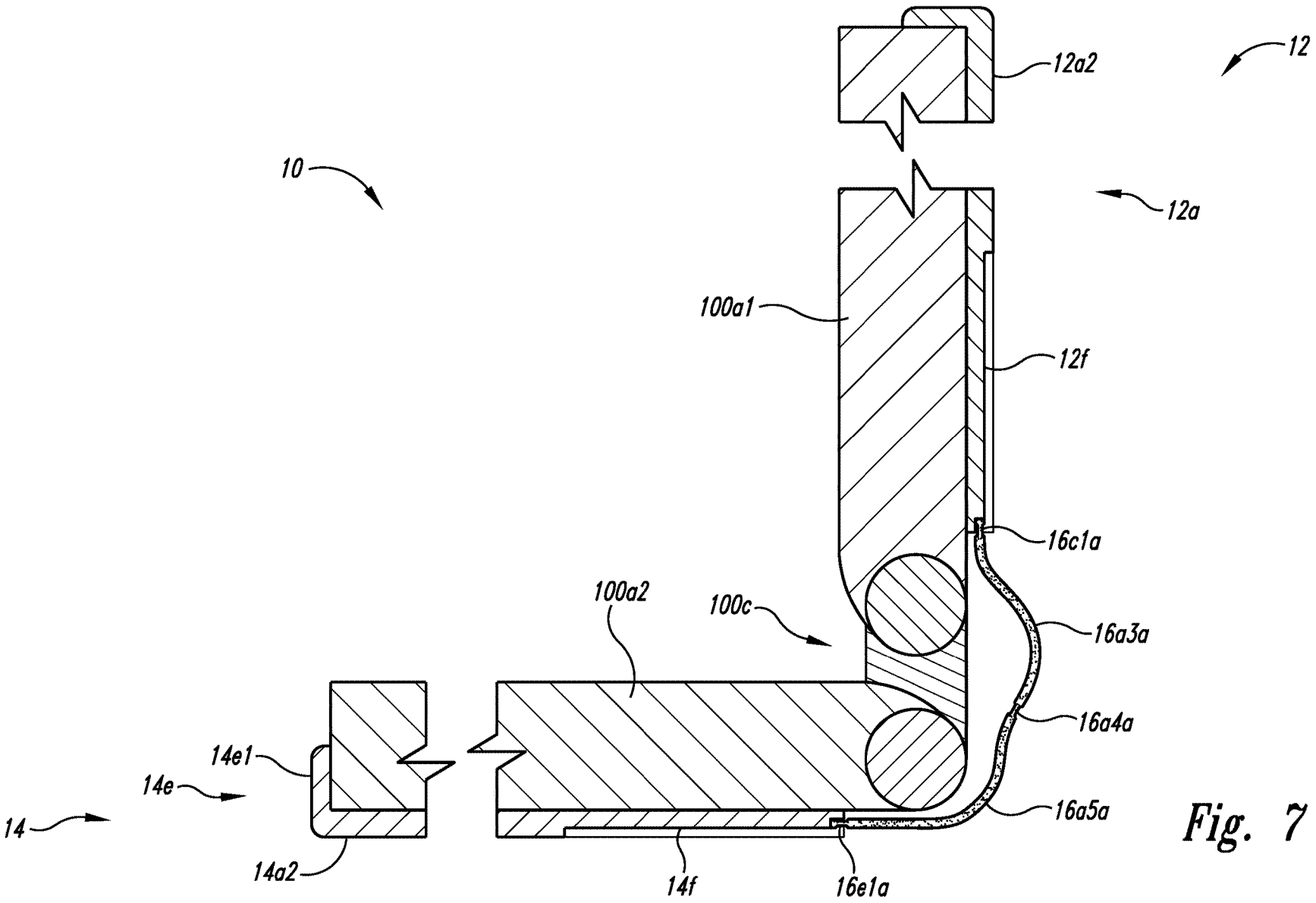
FIG. 7 is a side-elevational cross-sectional view of device case assembly of FIG. 4 in a transitioning spatial contour.

Turning to FIG. 7, depicted therein is a side-elevational cross-sectional view of device case assembly of FIG. 4 in a transitioning spatial contour.

Figure 8:
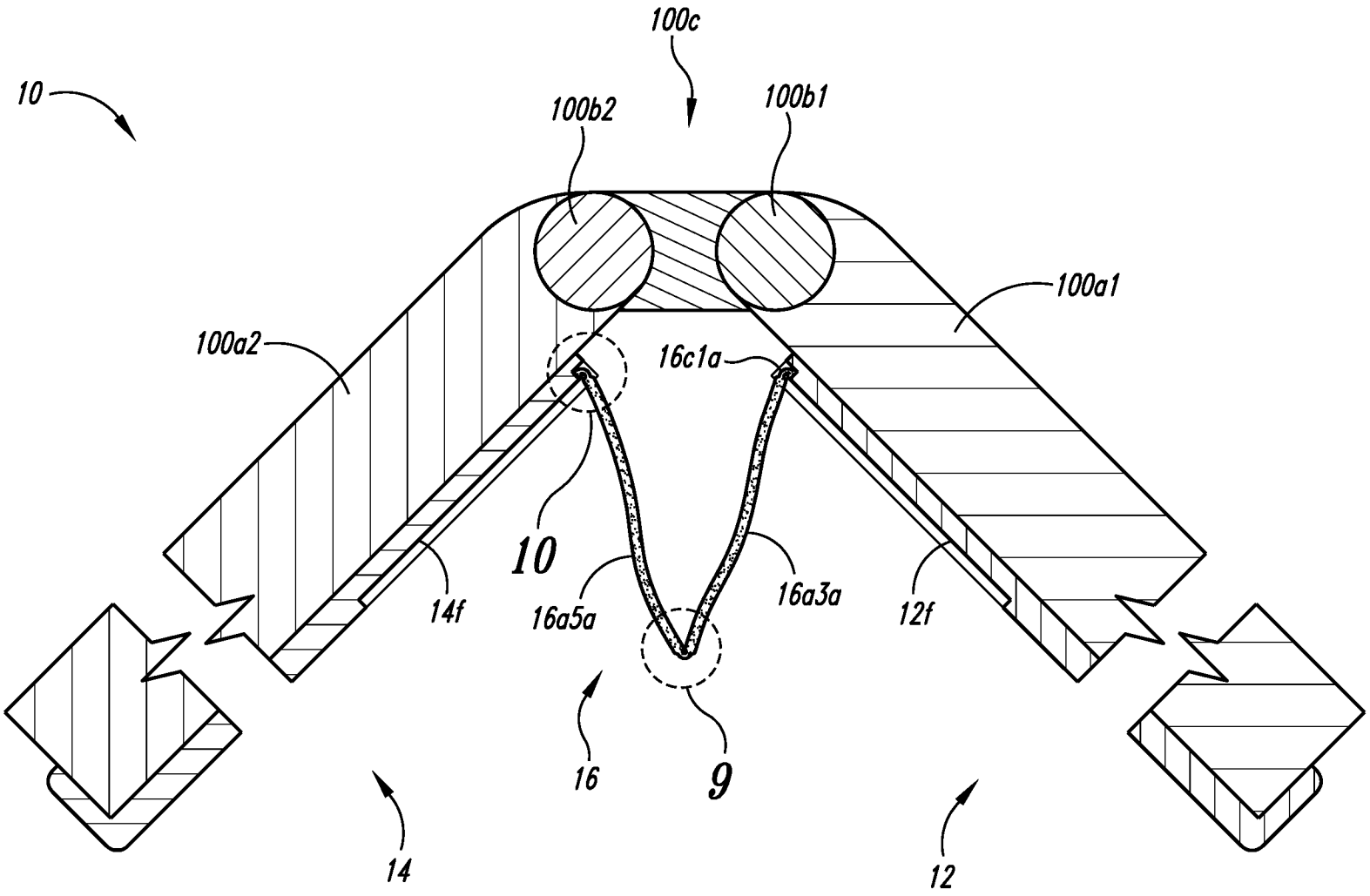
FIG. 8 is a side-elevational cross-sectional view of device case assembly of FIG. 4 in a transitioning spatial contour.

Turning to FIG. 8, depicted therein is a side-elevational cross-sectional view of device case assembly of FIG. 4 in a transitioning spatial contour.

Figure 9:
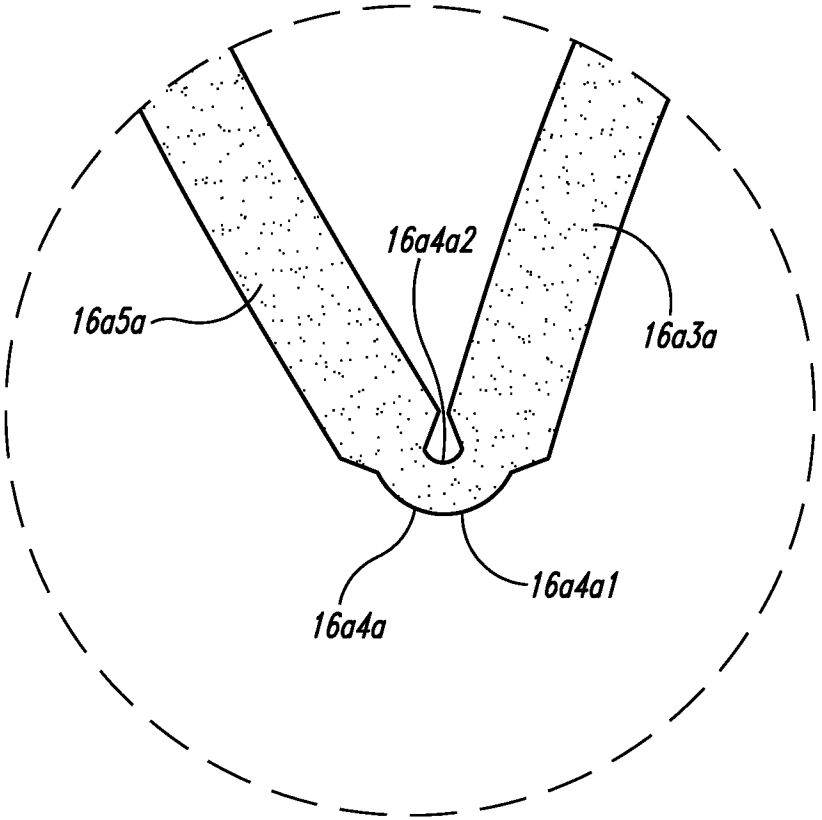
FIG. 9 is an enlarged side elevational cross-sectional view of a dashed-circle portion of the device case assembly of FIG. 8 labeled "9" shown in FIG. 8.

Turning to FIG. 9, depicted therein is an enlarged side elevational cross-sectional view of a dashed-circle portion of the device case assembly of FIG. 8 labeled "9" shown in FIG. 8.

Figure 10:
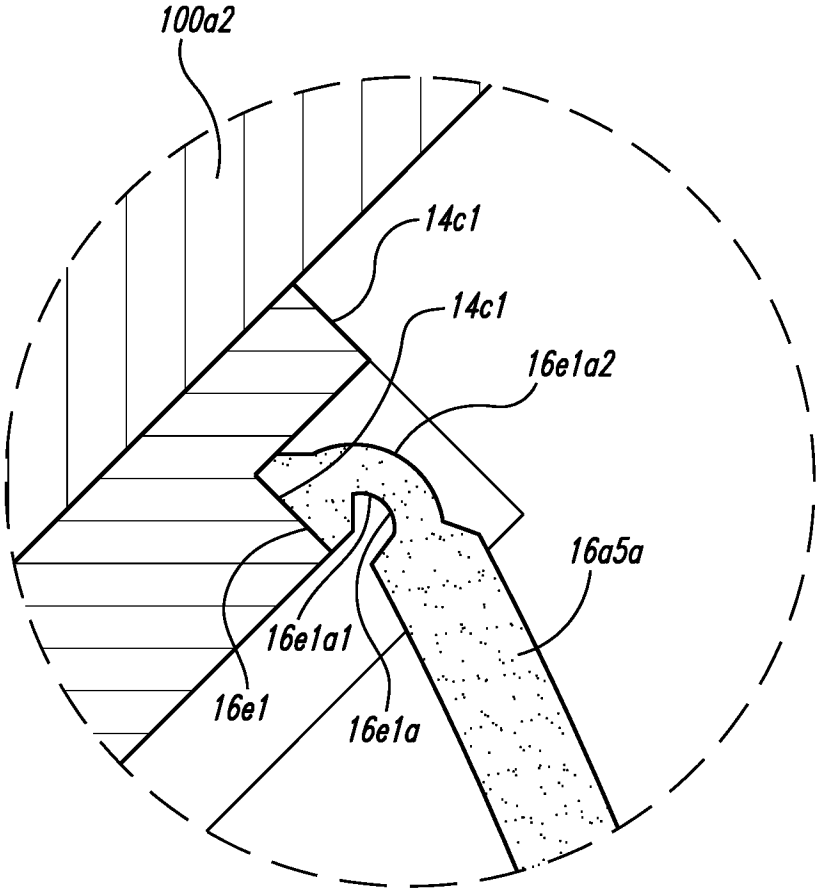
FIG. 10 is an enlarged side elevational cross-sectional view of a dashed-circle portion of the device case assembly of FIG. 8 labeled "10" shown in FIG. 8.

Turning to FIG. 10, depicted therein is an enlarged side elevational cross-sectional view of a dashed-circle portion of the device case assembly of FIG. 8 labeled "10" shown in FIG. 8.

Figure 11:
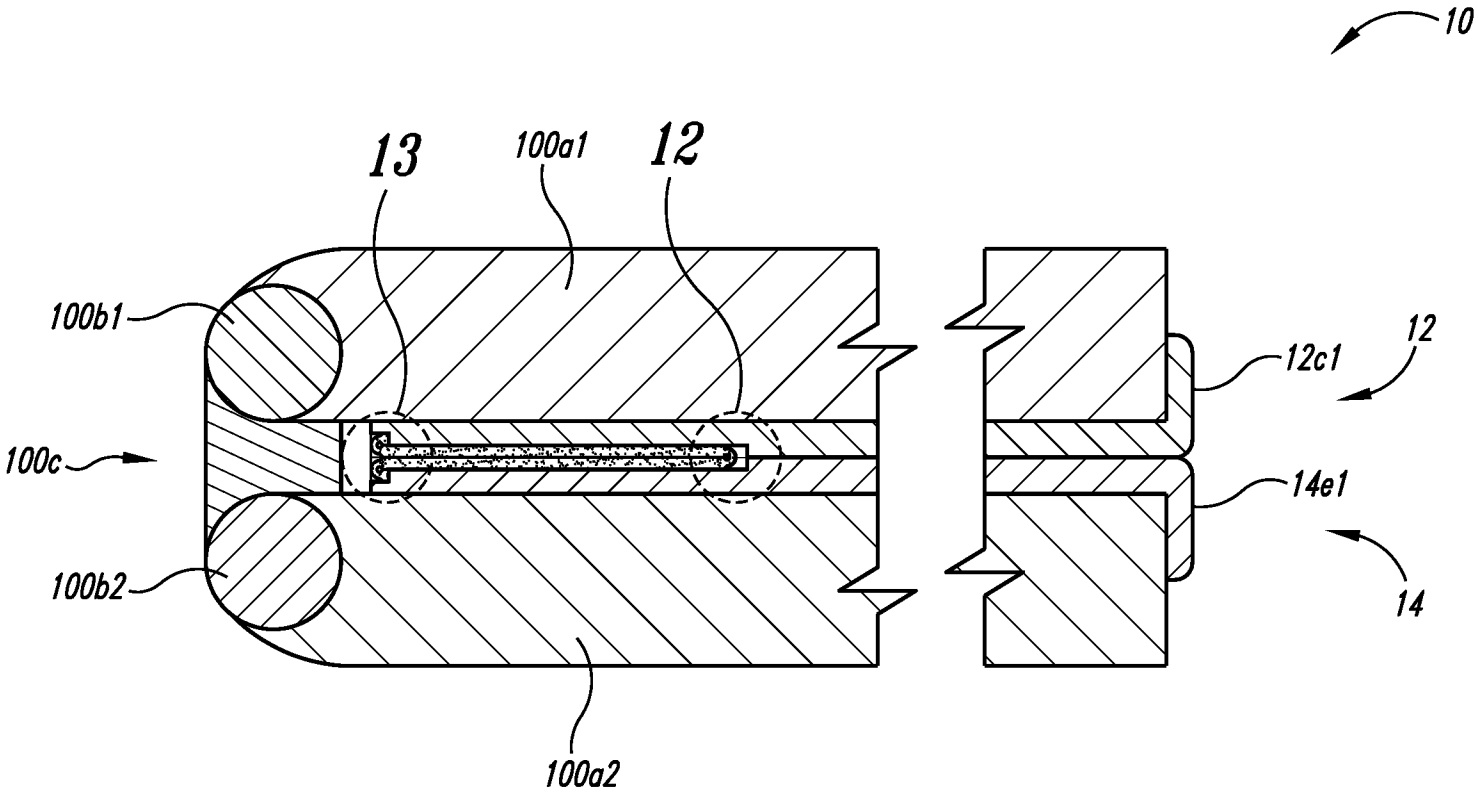
FIG. 11 is a side-elevational cross-sectional view of device case assembly of FIG. 4 in a second spatial contour.

Turning to FIG. 11, depicted therein is a side-elevational cross-sectional view of device case assembly of FIG. 4 in a second spatial contour, such as, for instance, to hold portable electronic computing device 100 as an open tablet.

Figure 12:
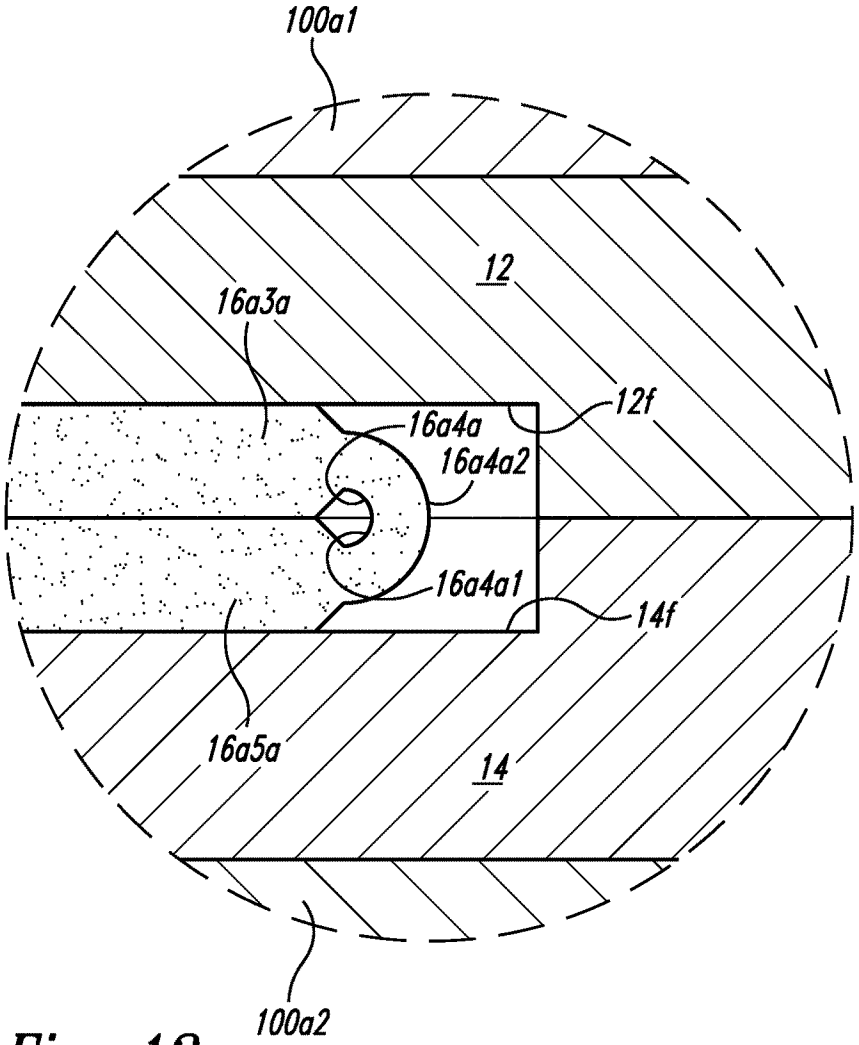
FIG. 12 is an enlarged side elevational cross-sectional view of a dashed-circle portion of the device case assembly of FIG. 11 labeled "12" shown in FIG. 11.

Turning to FIG. 12, depicted therein is an enlarged side elevational cross-sectional view of a dashed-circle portion of the device case assembly of FIG. 11 labeled "12" shown in FIG. 11.

Figure 13:
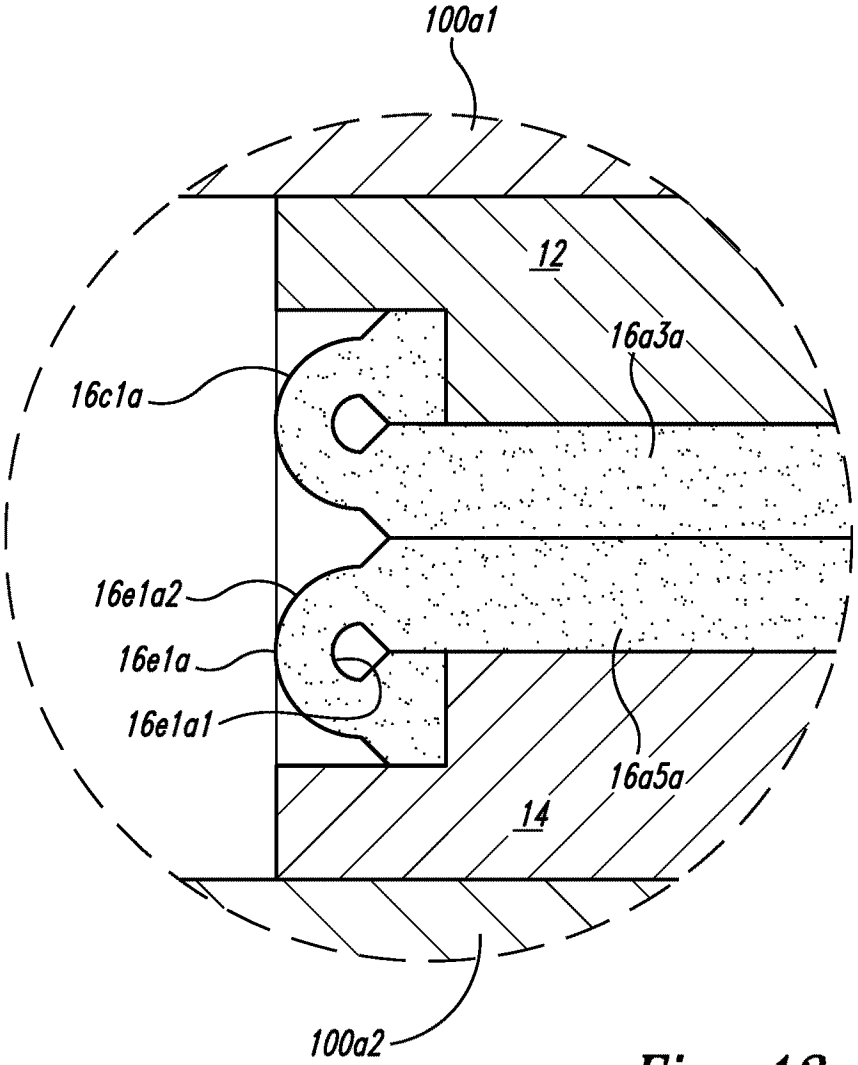
FIG. 13 is an enlarged side elevational cross-sectional view of a dashed-circle portion of the device case assembly of FIG. 11 labeled "13" shown in FIG. 11.

Turning to FIG. 13, depicted therein is an enlarged side elevational cross-sectional view of a dashed-circle portion of the device case assembly of FIG. 11 labeled "13" shown in FIG. 11.

Figure 14:
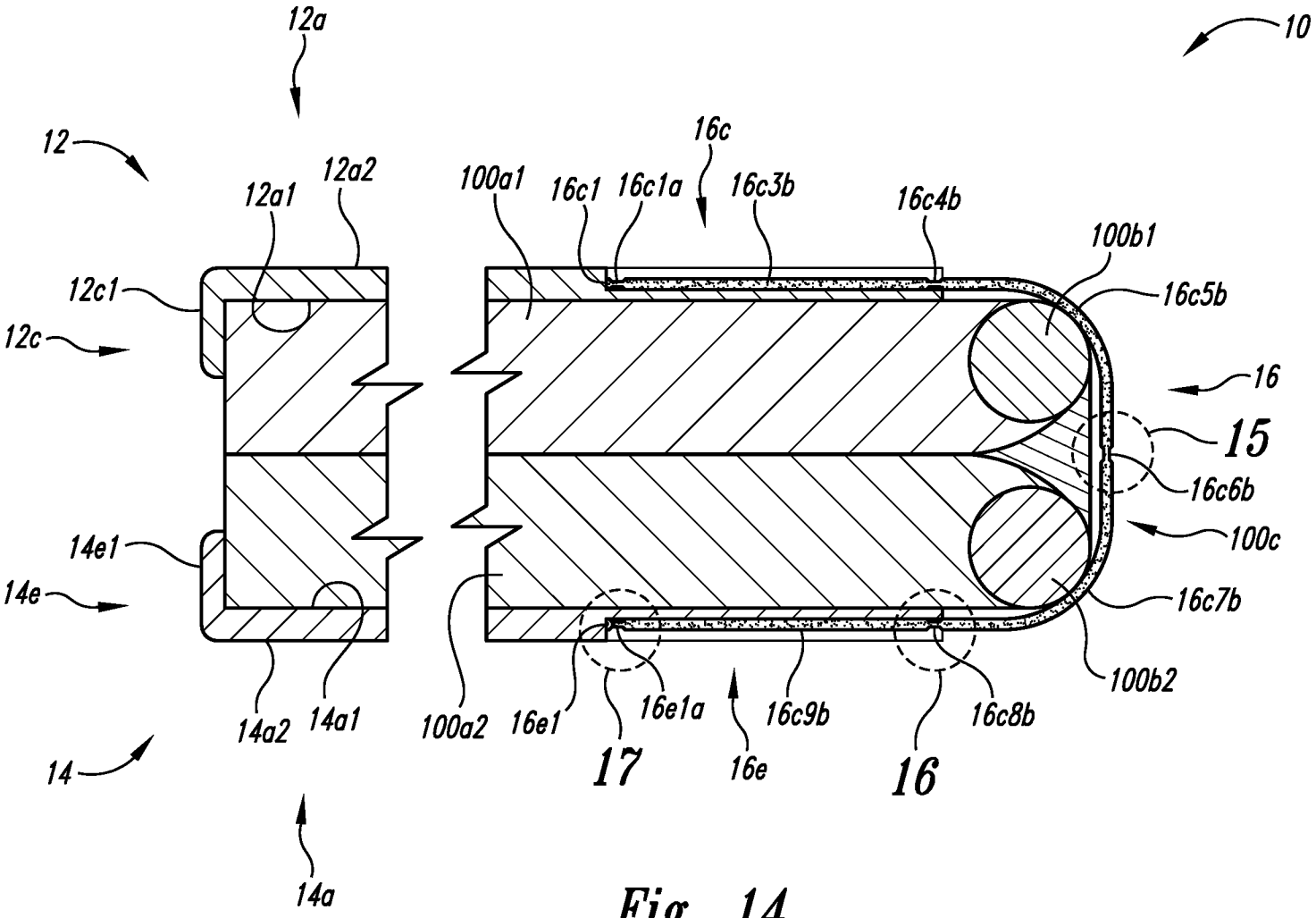
FIG. 14 is modification to FIG. 4 showing second configuration of device case assembly in first spatial contour.

Turning to FIG. 14, depicted therein is modification to FIG. 4 showing second configuration of device case assembly in first spatial contour, such as, for instance, to hold portable electronic computing device 100 as a closed laptop. In implementations of second configuration, sheet member 16 is shown to include first segment 16*c*3*b* and second segment 16*c*5*b* with mid-hinge 16*c*4*b* therebetween, second segment 16*c*5*b* and third segment 16*c*7*b* with mid-hinge 16*c*6*b* therebetween, third segment 16*c*7*b* and fourth segment 16*c*9*b* with mid-hinge 16*c*8*b*.

Figure 15:
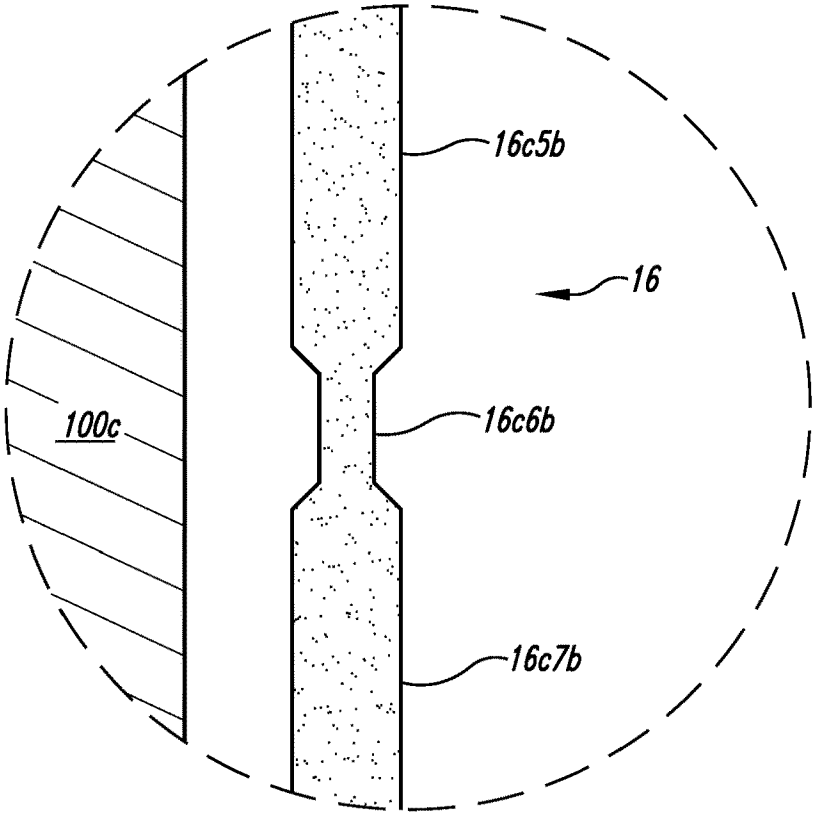
FIG. 15 is an enlarged side elevational cross-sectional view of a dashed-circle portion of the device case assembly of FIG. 14 labeled "15" shown in FIG. 14.

Turning to FIG. 15, depicted therein is an enlarged side elevational cross-sectional view of a dashed-circle portion of the device case assembly of FIG. 14 labeled "15" shown in FIG. 14.

Figure 16:
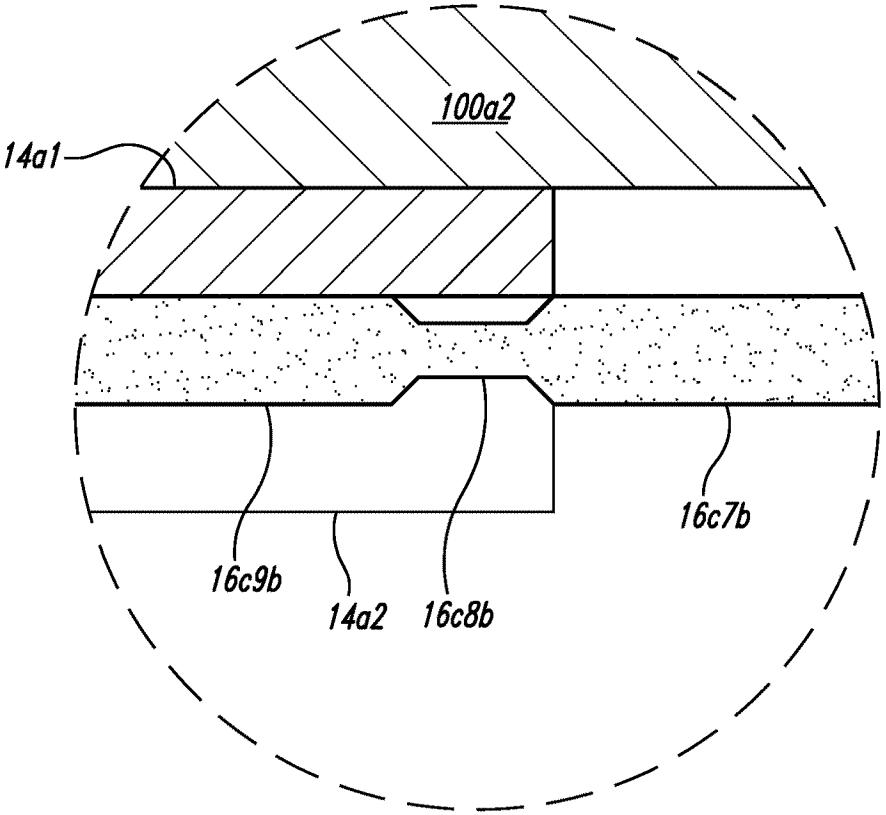
FIG. 16 is an enlarged side elevational cross-sectional view of a dashed-circle portion of the device case assembly of FIG. 15 labeled "16" shown in FIG. 15.

Turning to FIG. 16, depicted therein is an enlarged side elevational cross-sectional view of a dashed-circle portion of the device case assembly of FIG. 15 labeled "16" shown in FIG. 15.

Figure 17:
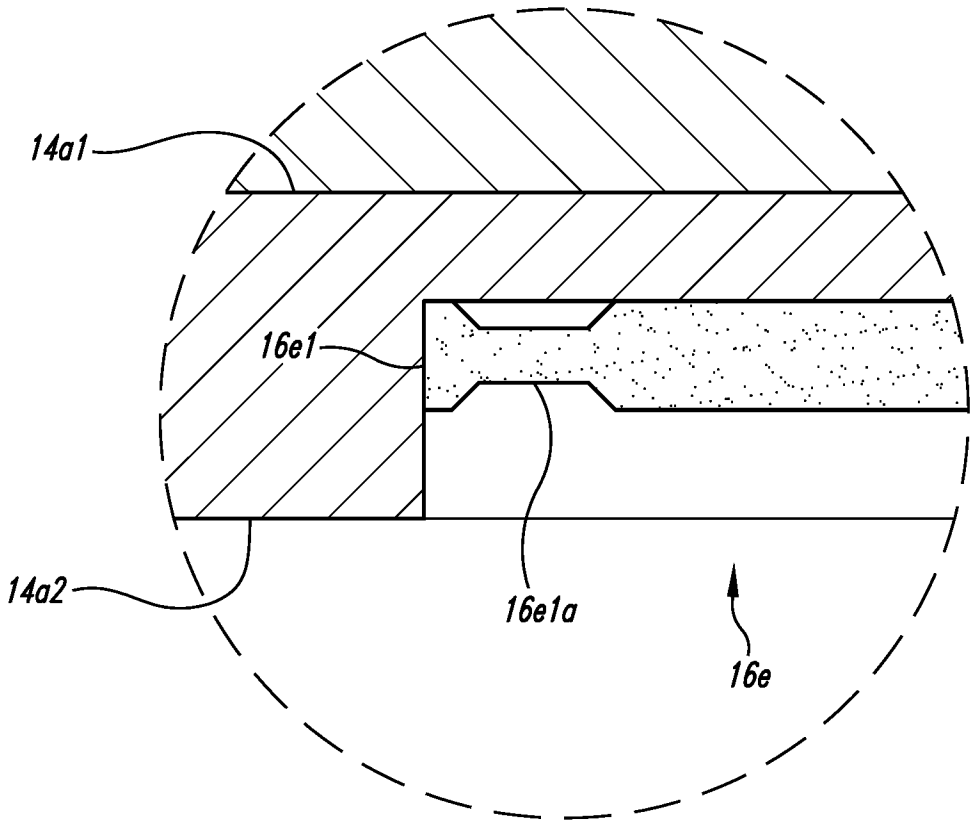
FIG. 17 is an enlarged side elevational cross-sectional view of a dashed-circle portion of the device case assembly of FIG. 16 labeled "17" shown in FIG. 16.

Turning to FIG. 17, depicted therein is an enlarged side elevational cross-sectional view of a dashed-circle portion of the device case assembly of FIG. 16 labeled "17" shown in FIG. 16.

Figure 18:
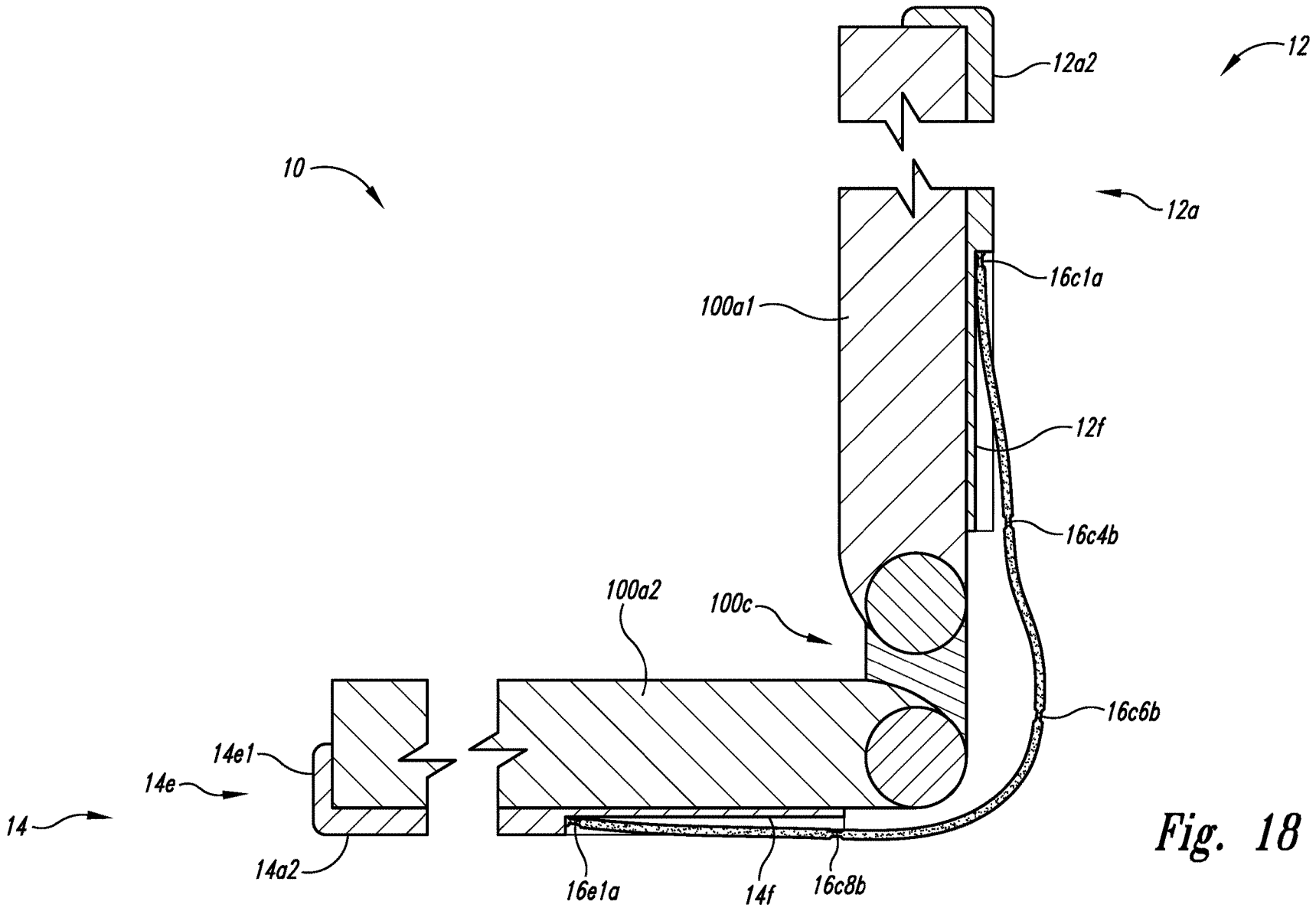
FIG. 18 is a side-elevational cross-sectional view of device case assembly of FIG. 14 in a transitioning spatial contour.

Turning to FIG. 18, depicted therein is a side-elevational cross-sectional view of device case assembly of FIG. 14 in a transitioning spatial contour.

Figure 19:
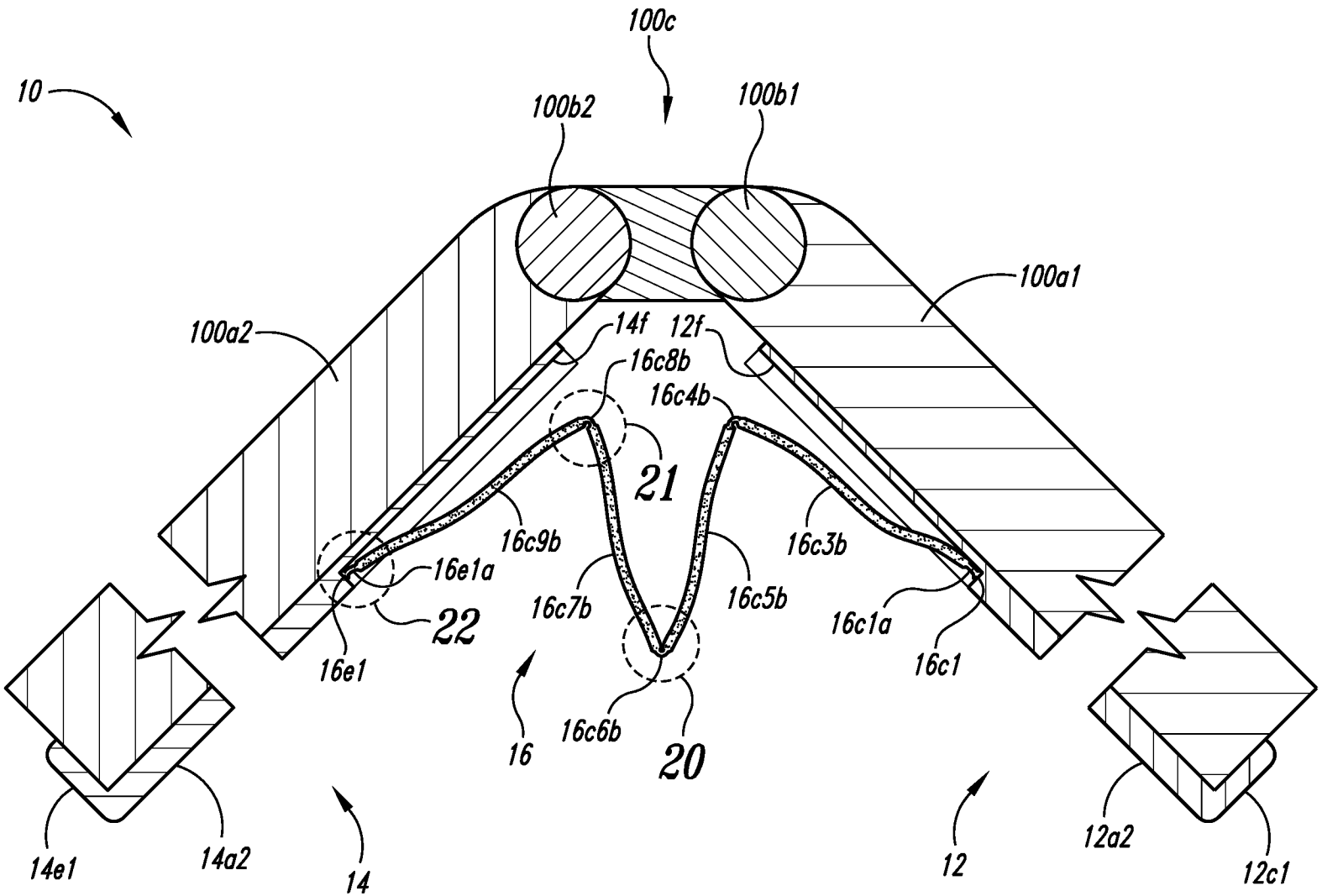
FIG. 19 is a side-elevational cross-sectional view of device case assembly of FIG. 14 in a transitioning spatial contour.

Turning to FIG. 19, depicted therein is a side-elevational cross-sectional view of device case assembly of FIG. 14 in a transitioning spatial contour.

Figure 20:
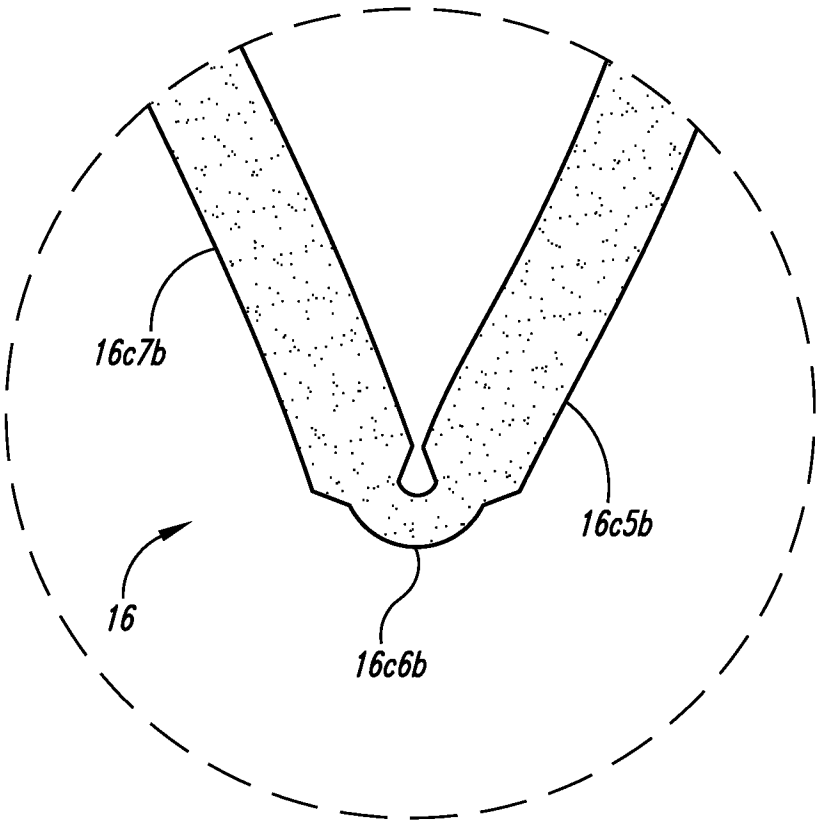
FIG. 20 is an enlarged side elevational cross-sectional view of a dashed-circle portion of the device case assembly of FIG. 19 labeled "20" shown in FIG. 19.

Turning to FIG. 20, depicted therein is an enlarged side elevational cross-sectional view of a dashed-circle portion of the device case assembly of FIG. 19 labeled "20" shown in FIG. 19.

Figure 21:
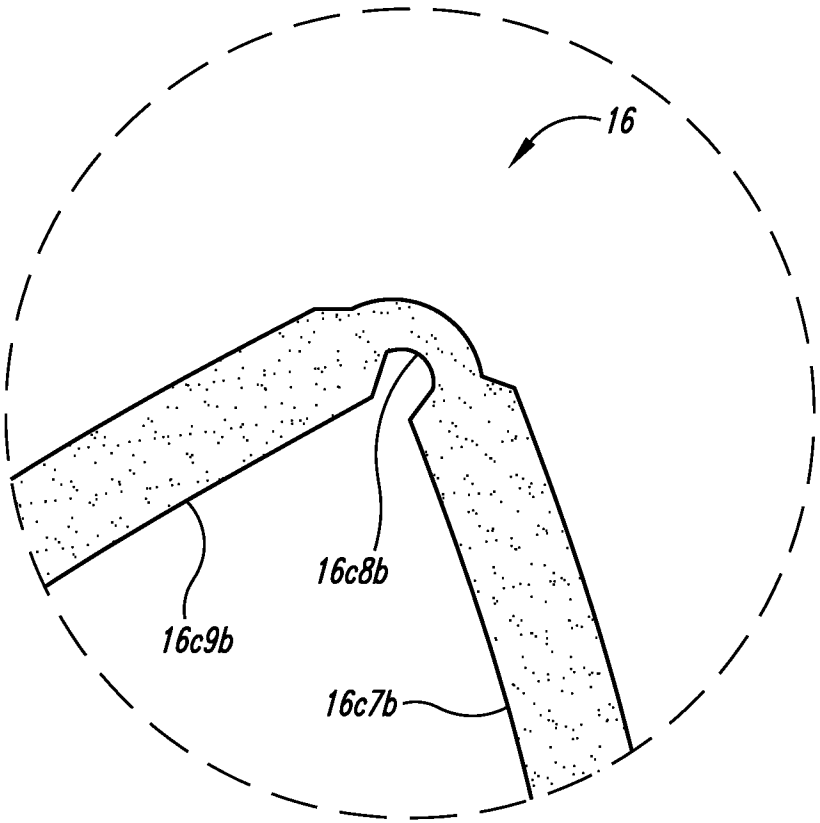
FIG. 21 is an enlarged side elevational cross-sectional view of a dashed-circle portion of the device case assembly of FIG. 19 labeled "21" shown in FIG. 19.

Turning to FIG. 21, depicted therein is an enlarged side elevational cross-sectional view of a dashed-circle portion of the device case assembly of FIG. 19 labeled "21" shown in FIG. 19.

Figure 22:
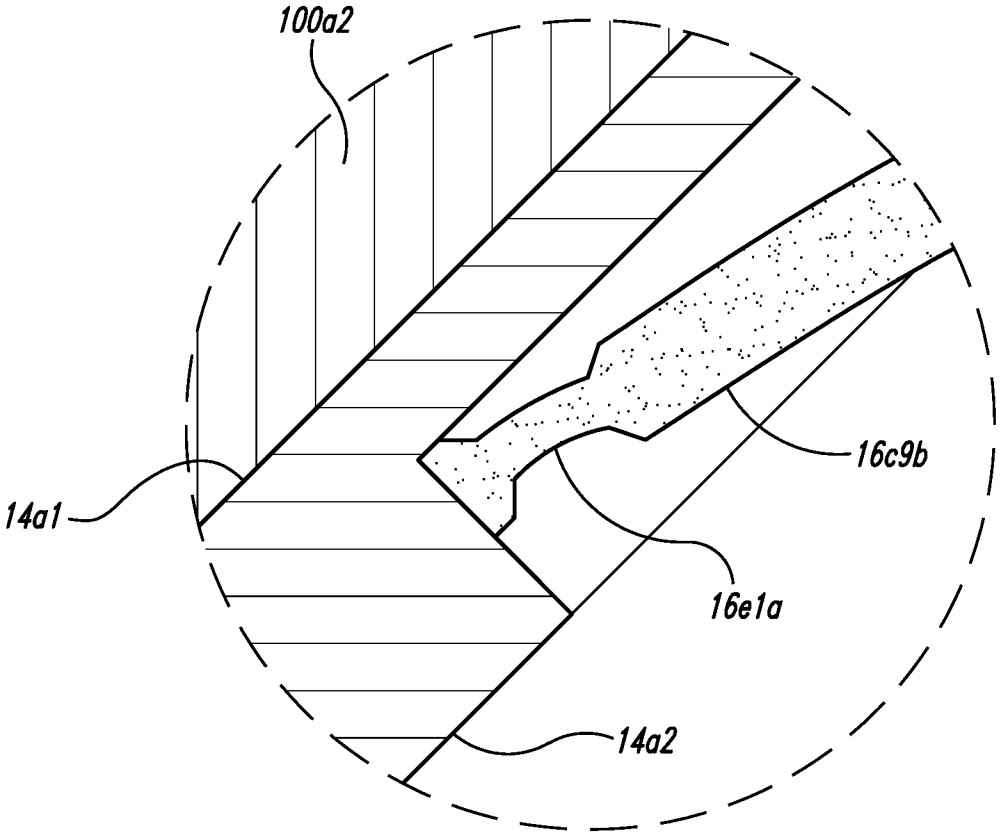
FIG. 22 is an enlarged side elevational cross-sectional view of a dashed-circle portion of the device case assembly of FIG. 19 labeled "22" shown in FIG. 19.

Turning to FIG. 22, depicted therein is an enlarged side elevational cross-sectional view of a dashed-circle portion of the device case assembly of FIG. 19 labeled "22" shown in FIG. 19.

Figure 23:
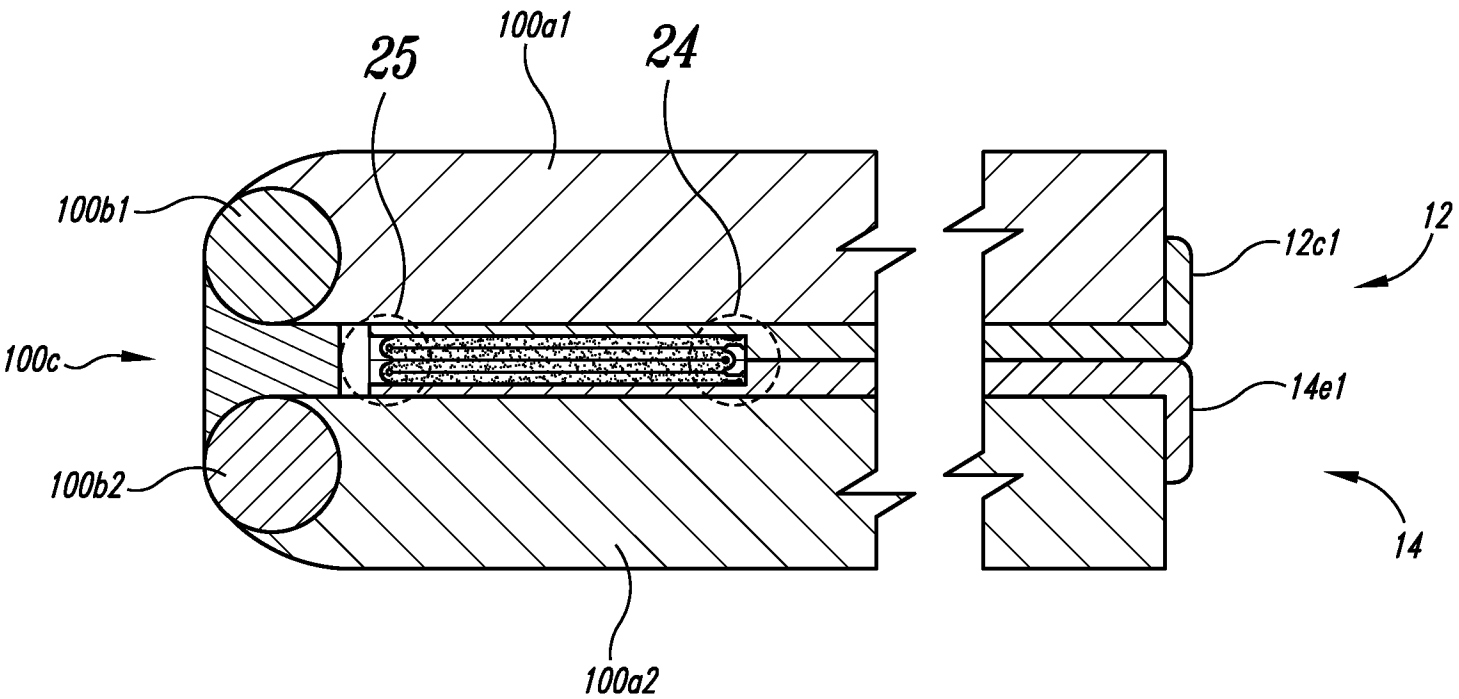
FIG. 23 is a side-elevational cross-sectional view of device case assembly of FIG. 14 in a second spatial contour.

Turning to FIG. 23, depicted therein is a side-elevational cross-sectional view of device case assembly of FIG. 14 in a second spatial contour such as, for instance, to hold portable electronic computing device 100 as an open tablet.

Figure 24:
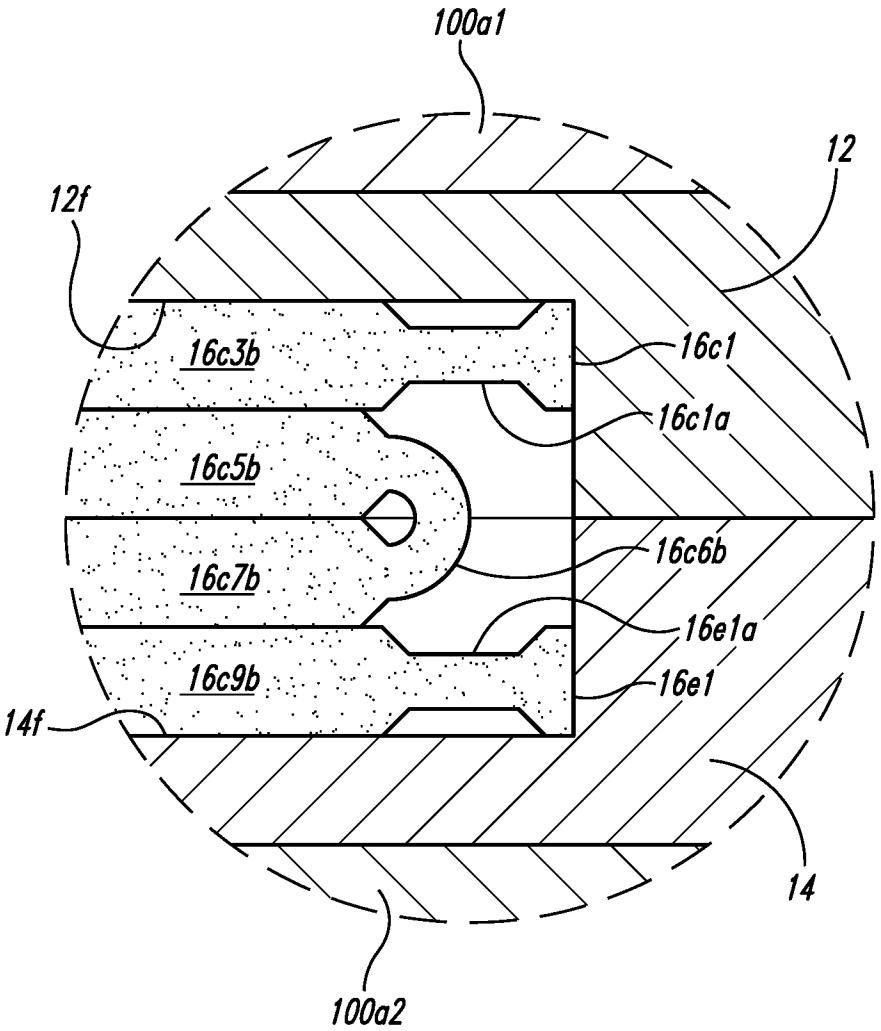
FIG. 24 is an enlarged side elevational cross-sectional view of a dashed-circle portion of the device case assembly of FIG. 23 labeled "24" shown in FIG. 23.

Turning to FIG. 24, depicted therein is an enlarged side elevational cross-sectional view of a dashed-circle portion of the device case assembly of FIG. 23 labeled "24" shown in FIG. 23.

Figure 25:
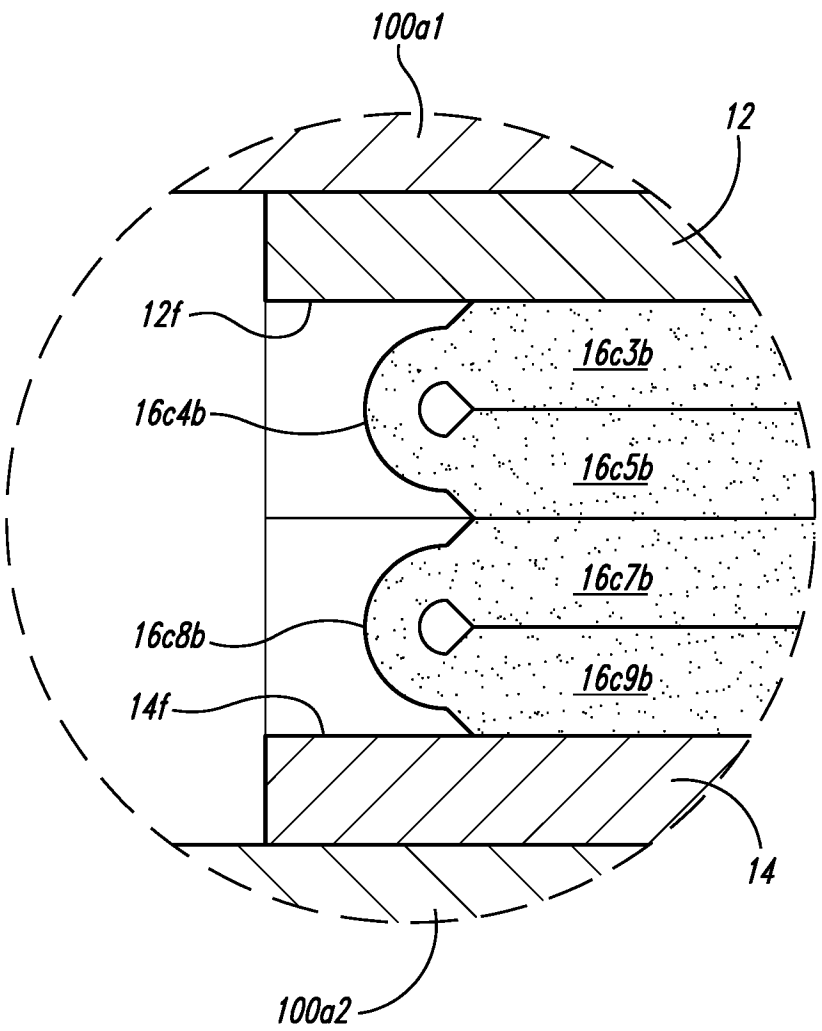
FIG. 25 is an enlarged side elevational cross-sectional view of a dashed-circle portion of the device case assembly of FIG. 23 labeled "25" shown in FIG. 23.

Turning to FIG. 25, depicted therein is an enlarged side elevational cross-sectional view of a dashed-circle portion of the device case assembly of FIG. 23 labeled "25" shown in FIG. 23.

As shown by one or more of FIGS. 1-25, implementations can include a system for a portable electronic computing device 100 including a first device portion 100*a*1 (e.g. display portion or keyboard portion), a second device portion 100*a*2 (e.g. keyboard portion or display portion), and a hinge portion 100*c*, the first device portion 100*a*1 (e.g. display portion or keyboard portion) hingedly coupled with the second device portion 100*a*2 (e.g. keyboard portion or display portion) via the hinge portion 100*c*, the system can include (I) a first case section 12 including (A) a base 12*a* including an interior surface 12*a*1, (B) a first side 12*b* including a first wall 12*b*1 with the first wall 12*b*1 extending perpendicularly to the interior surface 12*a*1, (C) a second side 12*c* including a second wall 12*c*1 with the second wall 12*c*1 extending perpendicularly to the interior surface 12*a*1, and (D) a third side 12*d* including a third wall 12*d*1 with the third wall 12*d*1 extending perpendicularly to the interior surface 12*a*1, wherein the first wall 12*b*1 extends perpendicularly to the second wall 12*c*1, and wherein the first wall 12*b*1 extends parallel with the third wall 12*d*1 such that the first case section 12 being configured to receive the first device portion 100*a*1 (e.g. display portion or keyboard portion) of the portable electronic computing device 100; (II) a second case section 14 including (A) a base 14*a* including an interior surface 14*a*1, (B) a first side 14*b* including a first wall 14*b*1 with the first wall 14*b*1 extending perpendicularly to the interior surface 14*a*1, (C) a second side 14*d* including a second wall 14*d*1 with the second wall 14*d*1 extending perpendicularly to the interior surface 14*a*1, and (D) a fourth side 14*e* including a third wall 14*e*1 with the third wall 14*e*1 extending perpendicularly to the interior surface 14*a*1, wherein the first wall 14*b*1 extends perpendicularly to the third wall 14*e*1, and wherein the first wall 14*b*1 extends parallel with the second wall 14*d*1 such that the second case section 14 being configured to receive the second device portion 100*a*2 (e.g. keyboard portion or display portion) of the portable electronic computing device 100; and (III) a sheet member 16 including (A) a base 16*a* coupled to the first case section 12 and coupled to the second case section 14, (B) the sheet member 16 including at least one portion of the base 16*a* being able to flexibly change between at least one first spatial contour and at least one second spatial contour, (C) a first surface portion of the base 16*a* being in physical contact with a second surface portion of the base 16*a* when the at least one portion of the base 16*a* is in the at least one first spatial contour, and (D) the first surface portion of the base 16*a* being without physical contact with the second surface portion of the base 16*a* when the at least one portion of the base 16*a* is in the at least one second spatial contour.

Implementations can include wherein the base 16*a* of the sheet member 16 is hingedly coupled to the first case section 12 and hingedly coupled to the second case section 14.

Implementations can include wherein the base 16*a* of the sheet member 16 includes at least one mid-hinge 16*a*4*a*, at least one first segment 16*a*3*a*, and at least one second segment 16*a*5*a*, the at least one mid-hinge 16*a*4*a* being positioned between the at least one first segment 16*a*3*a*, and the at least one second segment 16*a*5*a*.

Implementations can include wherein the at least one mid-hinge 16*a*4*a* includes at least one first notch 16*a*4*a*1 and at least one second notch 16*a*4*a*2.

Implementations can include wherein at least one portion of the at least one first segment 16*a*3*a* of the base 16*a* of the sheet member 16 being in physical contact with at least one portion of the at least one second segment 16*a*5*a* of the base 16*a* of the sheet member 16 when the at least one portion of the base 16*a* of the sheet member 16 is in the at least one first spatial contour.

Implementations can include wherein the first case section 12 includes a recess 12*f*, the second case section 14 includes a recess 14*f*, and when the at least one portion of the base 16*a* of the sheet member 16 is in the at least one first spatial contour, the at least one first segment 16*a*3*a* of the base 16*a* of the sheet member 16 is being received by the recess 12*f* of the first case section 12 and the at least one second segment 16*a*5*a* of the base 16*a* of the sheet member 16 is being received by the recess 14*f* of the second case section 14.

Implementations can include wherein the base 16*a* of the sheet member 16 includes a first segment 16*c*3*b*, a second segment 16*c*5*b*, a third segment 16*c*7*b*, a fourth segment 16*c*9*b*, a mid-hinge 16*c*4*b* positioned between the first segment 16*c*3*b* and the second segment 16*c*5*b*, a mid-hinge 16*c*6*b* positioned between the second segment 16*c*5*b* and the third segment 16*c*7*b*, and a mid-hinge 16*c*8*b* positioned between the third segment 16*c*7*b*, and the fourth segment 16*c*9*b*.

Implementations can include wherein when the base 16*a* of the sheet member 16 is in the at least one first spatial contour, at least one portion of the first segment 16*c*3*b* is in physical contact with at least a portion the second segment 16*c*5*b*, at least one portion of the second segment 16*c*5*b* is in physical contact with at least a portion of the third segment 16*c*7*b*, and at least one portion of the third segment 16*c*7*b* is in physical contact with at least a portion of the fourth segment 16*c*9*b*.

Implementations can include wherein the device case assembly 10 includes a recess 12*f* and when the at least one portion of the base 16*a* of the sheet member 16 is in the at least one first spatial contour, the first segment 16*c*3*b* and the second segment 16*c*5*b* of the base 16*a* of the sheet member 16 is being received by the recess 12*f*.

Implementations can include wherein the recess 12*f* of the device case assembly 10 is positioned in the first case section 12.

Implementations can include wherein the base 16*a* of the sheet member 16 being so coupled to the first case section 12 and so coupled to the second case section 14 to allow for 360-degree rotation of orientation of the first case section 12 with respect to the second case section 14.

Implementations can include wherein when the at least one portion of the base 16*a* of the sheet member 16 is in the at least one first spatial contour, the base 16*a* of the sheet member 16 is being folded over once onto itself.

Implementations can include wherein when the at least one portion of the base 16*a* of the sheet member 16 is in the at least one first spatial contour, the base 16*a* of the sheet member 16 is being folded over thrice onto itself.

Implementations can include wherein the first case section 12, the second case section 14, and the sheet member 16 are co-molded.

Implementations can include wherein at least one of more portions of the base 16*a* of the sheet member 16 is made of a fabric material.

Implementations can include wherein at least one portion of the base 16*a* of the sheet member 16 is made of a flexible synthetic material selected from a list including but not limited to metalized material, acrylonitrile material (ABS), low density polyethylene (LDPE) material, flexible plastic material, polyvinyl chloride material, thermoplastic polyurethane material, and silicone material.

Implementations can include wherein at least one portion of the first case section 12 and at least one portion of the second case section 14 are made of a hard material selected from a list including but not limited to high-density polyethylene (HDPE) plastic.

As shown by one or more of FIGS. 1-25, implementations can include a system for a portable electronic computing device 100 including a first device portion 100*a*1 (e.g. display portion or keyboard portion), a second device portion 100*a*2 (e.g. keyboard portion or display portion), and a hinge portion 100*c*, the first device portion 100*a*1 (e.g. display portion or keyboard portion) hingedly coupled with the second device portion 100*a*2 (e.g. keyboard portion or display portion) via the hinge portion 100*c*, the system can include (I) a first case section 12 including (A) a base 12*a* including an interior surface 12*a*1 such that the first case section 12 being configured to receive the first device portion 100*a*1 (e.g. display portion or keyboard portion) of the portable electronic computing device 100; (II) a second case section 14 including (A) a base 14*a* including an interior surface 14*a*1 such that the second case section 14 being configured to receive the second device portion 100*a*2 (e.g. keyboard portion or display portion) of the portable electronic computing device 100; and (III) a sheet member 16 coupled with and extending from the first case section 12 and coupled with and extending from the second case section 14 including at least one portion of the sheet member 16 being able to flexibly change between (A) a first position in which a first portion of the sheet member 16 is with physical contact with a second portion of the sheet member 16, and (B) a second position in which the first portion of the sheet member 16 is without physical contact with the second portion of the sheet member 16.

As shown by one or more of FIGS. 1-25, implementations can include a system for a portable electronic computing device 100 including a first device portion 100*a*1 (e.g. display portion or keyboard portion), a second device portion 100*a*2 (e.g. keyboard portion or display portion), and a hinge portion 100*c*, the first device portion 100*a*1 (e.g. display portion or keyboard portion) hingedly coupled with the second device portion 100*a*2 (e.g. keyboard portion or display portion) via the hinge portion 100*c*, the system can include (I) a first case section 12 including (A) a base 12*a* including an interior surface 12*a*1 such that the first case section 12 being configured to receive the first device portion 100*a*1 (e.g. display portion or keyboard portion) of the portable electronic computing device 100, (B) wherein the base 12*a* includes a recess 12*f*; (II) a second case section 14 including (A) a base 14*a* including an interior surface 14*a*1 such that the second case section 14 being configured to receive the second device portion 100*a*2 (e.g. keyboard portion or display portion) of the portable electronic computing device 100, (B) wherein the base 14*a* includes a recess 12*f*; and (III) a sheet member 16 coupled with and extending from the first case section 12 and coupled with and extending from the second case section 14 including at least one portion of the sheet member 16 being able to flexibly change between (A) a first position in which a first portion of the sheet member 16 is being received by the recess 12*f* and a second portion of the sheet member 16 is being received by the recess 14*f*; and (B) a first position in which a first portion of the sheet member 16 is being other than received by the recess 12*f* and a second portion of the sheet member 16 is being other than received by the recess 14*f*.

Implementations can include (A) wherein at least one portion of the base 16*a* of the sheet member 16 is made of a flexible synthetic material selected from a list including but not limited to metalized material, acrylonitrile material (ABS), low density polyethylene (LDPE) material, flexible plastic material, polyvinyl chloride material, thermoplastic polyurethane material, and silicone material, and (B) wherein at least one portion of the first case section 12 and at least one portion of the second case section 14 are made of a hard material selected from a list including but not limited to high-density polyethylene (HDPE) plastic.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

With respect to the appended claims, those skilled in the art will appreciate that recited operations therein may generally be performed in any order. Also, although various operational flows are presented in a sequence(s), it should be understood that the various operations may be performed in other orders than those which are illustrated, or may be performed concurrently. Examples of such alternate orderings may include overlapping, interleaved, interrupted, reordered, incremental, preparatory, supplemental, simultaneous, reverse, or other variant orderings, unless context dictates otherwise. Furthermore, terms like "responsive to," "related to," or other past-tense adjectives are generally not intended to exclude such variants, unless context dictates otherwise.

What is claimed is:

1. A system for a portable electronic computing device including a first device portion, a second device portion, and a hinge portion, the first device portion hingedly coupled with the second device portion via the hinge portion, the system comprising:

(I) a first case section including (A) a base including an interior surface, (B) a first side including a first wall with the first wall extending perpendicularly to the interior surface, (C) a second side including a second wall with the second wall extending perpendicularly to the interior surface, and (D) a third side including a third wall with the third wall extending perpendicularly to the interior surface, wherein the first wall extends perpendicularly to the second wall, and wherein the first wall extends parallel with the third wall such that the first case section being configured to receive the first device portion of the portable electronic computing device;

(II) a second case section including (A) a base including an interior surface, (B) a first side including a first wall with the first wall extending perpendicularly to the interior surface, (C) a second side including a second wall with the second wall extending perpendicularly to the interior surface, and (D) a fourth side including a third wall with the third wall extending perpendicularly to the interior surface, wherein the first wall extends perpendicularly to the third wall, and wherein the first wall extends parallel with the second wall such that the second case section being configured to receive the second device portion of the portable electronic computing device; and (III) a sheet member including (A) a base coupled to the first case section and coupled to the second case section, (B) the sheet member including at least one portion of the base being able to flexibly change between at least one first spatial contour and at least one second spatial contour, (C) a first surface portion of the base being in physical contact with a second surface portion of the base when the at least one portion of the base is in the at least one first spatial contour, and (D) the first surface portion of the base being without physical contact with the second surface portion of the base when the at least one portion of the base is in the at least one second spatial contour, wherein the base of the sheet member includes at least one mid-hinge, at least one first segment, and at least one second segment, the at least one mid-hinge being positioned between the at least one first segment, and the at least one second segment, wherein the first case section includes a recess, the second case section includes a recess, and when the at least one portion of the base of the sheet member is in the at least one first spatial contour, the at least one first segment of the base of the sheet member is being received by the recess of the first case section and the at least one second segment of the base of the sheet member is being received by the recess of the second case section.

2. The system of claim 1 wherein the base of the sheet member is hingedly coupled to the first case section and hingedly coupled to the second case section.

3. The system of claim 1 wherein the at least one mid-hinge includes at least one first notch and at least one second notch.

4. The system of claim 1 wherein at least one portion of the at least one first segment of the base of the sheet member being in physical contact with at least one portion of the at least one second segment of the base of the sheet member when the at least one portion of the base of the sheet member is in the at least one first spatial contour.

5. The system of claim 1 wherein the base of the sheet member being so coupled to the first case section and so coupled to the second case section to allow for 360-degree rotation of orientation of the first case section with respect to the second case section.

6. The system of claim 1 wherein when the at least one portion of the base of the sheet member is in the at least one first spatial contour, the base of the sheet member is being folded over once onto itself.

7. The system of claim 1 wherein the first case section, the second case section, and the sheet member are co-molded.

8. The system of claim 1 wherein at least one of more portions of the base of the sheet member is made of a fabric material.

9. The system of claim 1 wherein at least one portion of the base of the sheet member is made of a flexible synthetic material selected from a list including but not limited to metalized material, acrylonitrile material (ABS), low density polyethylene (LDPE) material, flexible plastic material, polyvinyl chloride material, thermoplastic polyurethane material, and silicone material.

10. The system of claim 1 wherein at least one portion of the first case section and at least one portion of the second case section are made of a hard material selected from a list including but not limited to high-density polyethylene (HDPE) plastic.

* * * * *